US005152733A

United States Patent [19]

Farenholtz et al.

[11] Patent Number: 5,152,733

[45] Date of Patent: * Oct. 6, 1992

[54] EXERCISE TESTING AND TRAINING APPARATUS

[75] Inventors: Douglas W. Farenholtz, 5409 - 45th Avenue, Delta, British Columbia, Canada, V4K 1L3; Matthew A. Bowers, Surrey; James A. McArthur, Coquitlam; Ian W. Isbister, Vancouver, all of Canada

[73] Assignee: Douglas William Farenholtz, Delta, Canada

[ * ] Notice: The portion of the term of this patent subsequent to Aug. 28, 2007 has been disclaimed.

[21] Appl. No.: 675,621

[22] Filed: Jun. 5, 1991

Related U.S. Application Data

[63] Continuation-in-part of Ser. No. 495,125, Mar. 19, 1990, Pat. No. 5,050,872, which is a continuation-in-part of Ser. No. 341,353, Apr. 21, 1989, Pat. No. 4,951,943.

[51] Int. Cl.[5] ..... B63B 21/00

[52] U.S. Cl. ..... 482/135; 482/86; 482/101

[58] Field of Search ..... 272/67, 117, 118, 134, 272/136, 142, DIG. 4; 73/379; 273/88 R; 482/44, 93, 99, 100, 101, 102, 103, 133, 135, 136, 137, 138, 83, 86

[56] References Cited

U.S. PATENT DOCUMENTS

| | | | |
|---|---|---|---|
| 88,047 | 3/1869 | Lawrence . | |
| 1,861,012 | 5/1932 | Hornbeck et al. . | |
| 3,072,400 | 1/1963 | Dykinga . | |
| 3,438,627 | 4/1969 | Lanne . | |
| 3,464,696 | 9/1969 | Hooker . | |
| 3,649,016 | 5/1972 | Kelly, Jr. . | |
| 3,659,847 | 5/1972 | Gow . | |
| 3,851,874 | 12/1974 | Wilkin . | |
| 3,942,796 | 3/1976 | Bowen . | |
| 4,063,727 | 12/1977 | Hall . | |
| 4,068,843 | 1/1978 | Frost . | |
| 4,149,714 | 4/1979 | Lambert, Jr. . | |
| 4,154,441 | 5/1979 | Gajda . | |
| 4,209,167 | 6/1980 | Jansen . | |
| 4,373,717 | 2/1983 | Lambert, Jr. . | |
| 4,402,504 | 9/1983 | Christian . | |
| 4,422,636 | 12/1983 | De Angeli . | |
| 4,441,706 | 4/1984 | Korzaniewski . | |
| 4,600,188 | 7/1986 | Bangerter et al. . | |
| 4,600,189 | 7/1986 | Olschansky et al. | 272/118 |
| 4,603,855 | 8/1986 | Sebell . | |
| 4,632,388 | 12/1986 | Schleffendorf . | |
| 4,720,103 | 6/1988 | Palladino, Jr. . | |
| 4,721,303 | 1/1988 | Fitzpatrick . | |
| 4,799,671 | 1/1989 | Hoggan et al. . | |
| 4,826,157 | 5/1989 | Fitzpatrick . | |
| 4,842,270 | 6/1989 | Lange . | |
| 4,898,381 | 2/1990 | Gordon . | |
| 4,951,943 | 8/1990 | Farenholtz | 272/118 X |
| 5,050,872 | 9/1991 | Farenholtz | 272/134 |

FOREIGN PATENT DOCUMENTS

| | | |
|---|---|---|
| 2541574 | 8/1984 | France . |
| 604340 | 5/1960 | Italy . |
| 2184953 | 7/1987 | United Kingdom . |

*Primary Examiner*—Robert Bahr
*Attorney, Agent, or Firm*—Bull, Housser & Tupper

[57] ABSTRACT

An exercise, testing and training apparatus includes an upstanding frame, a support rotatably supported by the frame for rotation about a support axis of rotation, a resisting force, such as a weight stack, a force receiving extension supported by the support having a longitudinal axis perpendicular to the axis of the support axis, the extension movable with respect to the support along the longitudinal axis to cause force to be applied against the resisting force, and a resisting force connected device for connecting the extension to the resisting force being responsive to the application of force on the extension to cause force to be applied against the resisting force when the extension is moved along the longitudinal axis. The resisting force may be supported by the frame and a portion of the connecting device may extend parallel with and pass substantially through, the support axis.

59 Claims, 15 Drawing Sheets

48
132
14
190
10
22
20
79
74
66
72
16
63
72
71
14
122
18
81
76
75
68
104
78
80
70
77
82
18
84
111
86
134
136
172
140
174
14
42
33
34
146
186
148
62
110
40
56
58
150
36
64
60
194
14
168
162
196
12
14
158
19
17
30
54
152
63
44
12
28
24

52
50
32
26
46
46

EXERCISE TESTING AND TRAINING APPARATUS

This is a continuation-in-part of application Ser. No. 07/495,125 filed Mar. 19, 1990 which, now U.S. Pat. No. 5,050,872, in turn, is a continuation-in-part of application Ser. No. 07/341,353 now U.S. Pat. No. 4,951,943, for an EXERCISE AND TRAINING APPARATUS.

BACKGROUND OF THE INVENTION

The present invention relates generally to an exercise, testing and training apparatus and, more particularly, to a training apparatus which is rotatable about a horizontal plane to permit the application of force by a user, in any direction with respect to the apparatus and which permits pushing, pulling and rotational forces to be simultaneously applied against a resisting force.

Training or exercising equipment used to develop muscle strength and which is used to test the relative strength of individuals, is well known. Such equipment usually consists of a mechanism by which the user can apply force against a resisting force contained in the apparatus. Commonly, a user applies force against a specific gripping or force receiving mechanism, which is connected to a cable. The cable is, in turn, connected, by means of one or more pulleys, to a specific weight or other force resisting means. When force is applied on the gripping means, the weight is lifted. Alternatively the weight may be replaced by a spring, pneumatic cylinders or motorized resistance which provide a resisting force when force is applied on the gripping mechanism by the user.

Most of these prior art training or exercise devices provide a relatively specific orientation of the user to the gripping or force receiving mechanism. There is no provision for moving such gripping means in a horizontal plane to permit the user to apply force against the machine in a realistic, functional and dynamic manner in a variety of positions which relate to many work, sport or exercise positions about the exercise machine. See for example U.S. Pat. No. 4,632,388 issued to Schleffendorf which requires the user to orient himself opposite rigid arm 16 in order to properly use the exercising system disclosed. The Schleffendorf device does not provide for use of the device by the user while positioned in a variety of positions around the circumference of the device.

A further example of such an exercise machine is disclosed in U.S. Pat. No. 4,441,706 issued to Korzaniewski. A rigidly positioned arm 26 extends outwardly form the frame requiring the user to stand opposite this arm in order to use the device.

U.S. Pat. No. 4,603,855 issued to Sebelle discloses an exercise device having a pair of opposed gripping elements connected to the frame of the device by respective arms which may be rotated along a restricted arc about a vertical axis of the arms. The arms, however, must be rigidly affixed in a pre-determined position along said arc for use in applying force against the resisting force of the exercise device.

It is also desirable, at times, to use such exercising and training devices by applying, pushing, pulling and rotational forces either separately or simultaneously in combination in a realistic simulation of functional work or sport applications of force. These prior exercising devices do not permit one to apply pushing and/or pulling force against the resisting force without making substantial modifications to the device, for example, by modifying pulley and cable positions. Furthermore, these prior exercising devices do not permit the return of the arm to a pre-determined normal position when the application of force is released from the arm.

An example of an exercise machine designed to provide exercise in a specific training regime is disclosed in U.S. Pat. No. 4,068,843 issued to Frost. The Heavy-duty Swivel Arm-wrestler and Exerciser patented by Frost requires the user to position him/herself rigidly relative to the machine and place the elbow of the exercising arm on the table to grip the gripping device. The Frost patent is used generally for training to develop the muscular strength and endurance relative to arm wrestling.

A further example of an exercising device is disclosed in U.S. Pat. No. 3,464,696 issued to Hooker. A football tackling dummy apparatus has a track pivotally mounted to rotate within a limited arc with a carriage slidable upon the track and a tackling dummy suspended from the carriage. The user strikes the dummy from the direction of the frame and moves it outwardly on the track. Another individual (the coach) may pivot the track laterally to add difficulty and added realism to the regime. A spring resistance, attached to the inner end of the track at one end and to the slideable dummy at the other, acts as the resisting force.

Additionally, U.S. Pat. No. 3,942,796 issued to Bowen discloses a football practice blocking and tackling reaction Machine. This patent discloses a horizontal beam which is pivotal about an upright frame. The arm includes a vertically pivotal support arm for mounting a tackle dummy. The dummy may be pushed in an upright or raised position to apply force against a resisting force. Again, a spring resistance is provided, the resistance connected between the arm and a portion of the frame.

U.S. Pat. No. 4,720,103 issued to Palladino, Jr., discloses a training device for football players, which includes a carriage which moves along a fixed track. A force receiving device is attached to the carriage so that when a user contacts the device the device is slid along the track horizontally and at an upward angle similar to the optimal force direction when making lineman contact during a football game.

None of these prior disclosures disclose:

1. an exercise device having a lateral extension slideable within a rotatable housing to apply force against a resisting force,
2. an exercise device permitting rotation of the force receiving means about a 360 degree unrestricted rotational axis and permitting force to be applied against the resisting force from any direction about the device,
3. an exercise device permitting the application of pushing force on an outwardly extending extension and simultaneous or separate pulling force applied on a gripping device, and
4. an exercise device permitting simultaneous, or separate, application of force in a variety of directions against the resisting force and return to the respective rest positions upon release of that force.

Consequently, there is a need for a training and exercise device having an outwardly extending extension readily contactable by the user for applying pushing force against the resisting force with minimal interference with other components of the device. There is also a need for a training and exercise apparatus which provides a rotatable arm for rotation in a horizontal plane to permit the user to apply force on the machine from a variety of positions about circumference of the machine. As well, there is a need for a training and exercise apparatus which can accept pulling, pushing and rotational forces (about three separate axes), either separately or simultaneously, to apply force against the resisting force of the machine. There is further a need for a training and exercise apparatus which may move in the manner described above and return to the various pre-determined normal positions upon release of force on the apparatus. And, further yet, there is a need for a training and exercise and testing apparatus which can functionally and realistically simulate work or sport related lifting and pulling or lifting and pushing tasks such as pulling on a fire hose or lifting and pushing a box onto a shelf or lifting, carrying and then pushing a stretcher into an ambulance or lifting, carrying and pulling on a fire ladder to place it in position against a wall, and a variety of other simulated force applications.

SUMMARY OF INVENTION

The present invention provides a testing, training and exercise apparatus having an upstanding frame, a support means rotatably supported by the frame for rotation about a support axis of rotation, a resisting force and a force receiving extension with a longitudinal axis perpendicular to the axis of the support axis. The extension is movable along the support to cause force to be applied against the resisting force when the extension is moved longitudinally along the support. A resisting force is also included and a resisting force connecting means for connecting the extension to the resisting force, responsive to the application of force on the extension to cause force to be applied against the resisting force.

Alternately, the resisting force may be supported by the frame, and a portion of the connecting means may extend parallel with, and pass substantially through, the support axis. In addition, the extension may include a first end extending along the longitudinal axis of the extension beyond the periphery of the support. The first end is pushable to apply pressure to move the extension longitudinally along a support to cause force to be applied against the resisting force.

The apparatus may include a pendulum swing for movably connecting the extension to the support means. The pendulum swing permits slidable movement of the extension along its longitudinal axis between a rest position wherein the first end of said extension extends substantially from the support means and a retracted position wherein the first end of the extension is essentially retracted in said support means and wherein force is applied against the resisting force when the extension is moved toward the retracted position. Alternately, the extension may include rotatable wheels and the support may include a longitudinal track adapted to receive the wheels for rolling on the track. As a further alternative the extension may include a sliding portion, and the support may include a complimentary sliding portion which slideably connect the extension to the support. Alternately, a meshing gear arrangement may be used to slidably connect the extension to the support.

Optionally, the apparatus may include a housing support structure to which is attached linear ball bushings through which a rod passes and which is attached to each end of a slideable arm. The linear ball bushings allow the rod to slide efficiently forward and backward through the housing.

Advantageously, the extension is longitudinally slidable within the housing to cause force to be applied against the resisting force when the force receiving means is pushed within the housing toward the frame, by a user. Alternatively, one end of the connecting means may be pulled by the user to move the extension arm within the housing toward the frame to cause force to be applied against the resisting force.

Preferably, the extension includes a first gripping means for gripping by a user to apply force on the force receiving means.

As a further option the apparatus my include a target removably attached to the force receiving extension. The target may be an artificial human-shaped dummy. The human-shaped dummy being comprised of a torso which is removably attached to the force receiving extension. A neck and head which is removably attached to the torso, removable, flexible arms which bend at the wrist, rotate and bend at the elbow and rotate at the shoulder joint to the torso which are designed to position at any angle relative to the front alignment of the body independent of each other, and removable legs which are designed to position at any angle relative to the front alignment of the body independent of each other. Further, the dummy is constructed to simulate a human form which would accommodate additional padding or equipment such as hockey or football padding, and extra padding for striking drills. Additionally the human form has the consistency of the human body and has vital areas marked for striking training purposes, these vital areas are constructed with an electrical circuit contact such that when the area is struck a sounding device provides audible feedback to the user as to the correctness of the strike.

As a further option, the apparatus may have height adjusting means to adjust the height of the rotatable housing with respect to the support surface.

As well, optionally, the apparatus may include a second arm connected to the frame. The second arm, which is an "A" frame, may be selectively attached to the top or bottom of the resistance supporting frame. The pulley means is attached to the end of the extension and the connecting means is a cable which extends through the pulley means and wherein the pulley is pullable to cause the force to be applied against the resisting force. The pulley means comprises a tension belt wheel system which is slipable when the user selected resistance is equal to the slip friction tension set against the wheel thereby lifting the weight. Gripping handles may be selectively attached to the cable connecting means which requires the user to simulate lifting, carrying and pushing similar to the applied force, for example, used by stretcher bearers.

Optionally, the apparatus may include a treadmill means for providing a movable support surface for the user to move on, the treadmill means includes a movable upper surface, the speed of movement being responsive to user input, motor driven or a combination of motor driven and user input. The treadmill means is positioned opposite the rotatable arm, and communicates directly with the resistance force, so that the user may apply force against the force receiving means and simultaneously be supported by and move with the treadmill means the combination of which applies force against the force receiving means.

The force resisting means may include various means for applying a resisting force, for example, free or stacked weights, a spring or pneumatic cylinder, tension wheel and belt system, motor or magnetic resistance. Various connecting means may be utilized. For example, a cable, wire, rope, chain or gear may be used as the connecting means.

DESCRIPTION OF THE PREFERRED EMBODIMENTS

Figure 1:
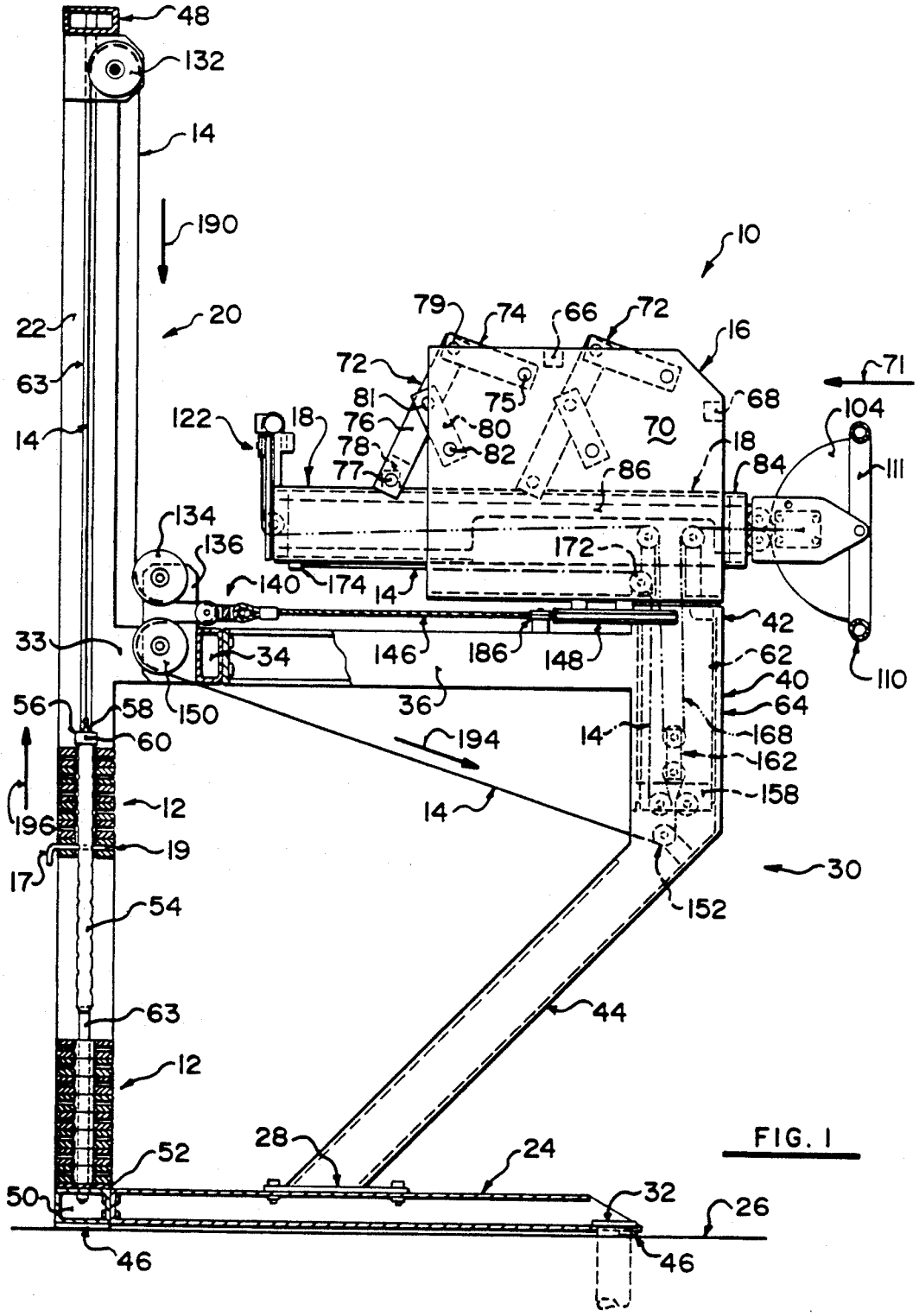
FIG. 1 is a side elevation view of a preferred embodiment of the testing, training and exercise apparatus showing the extension arm in a retracted position and various internal parts by broken line.
Figure 2:
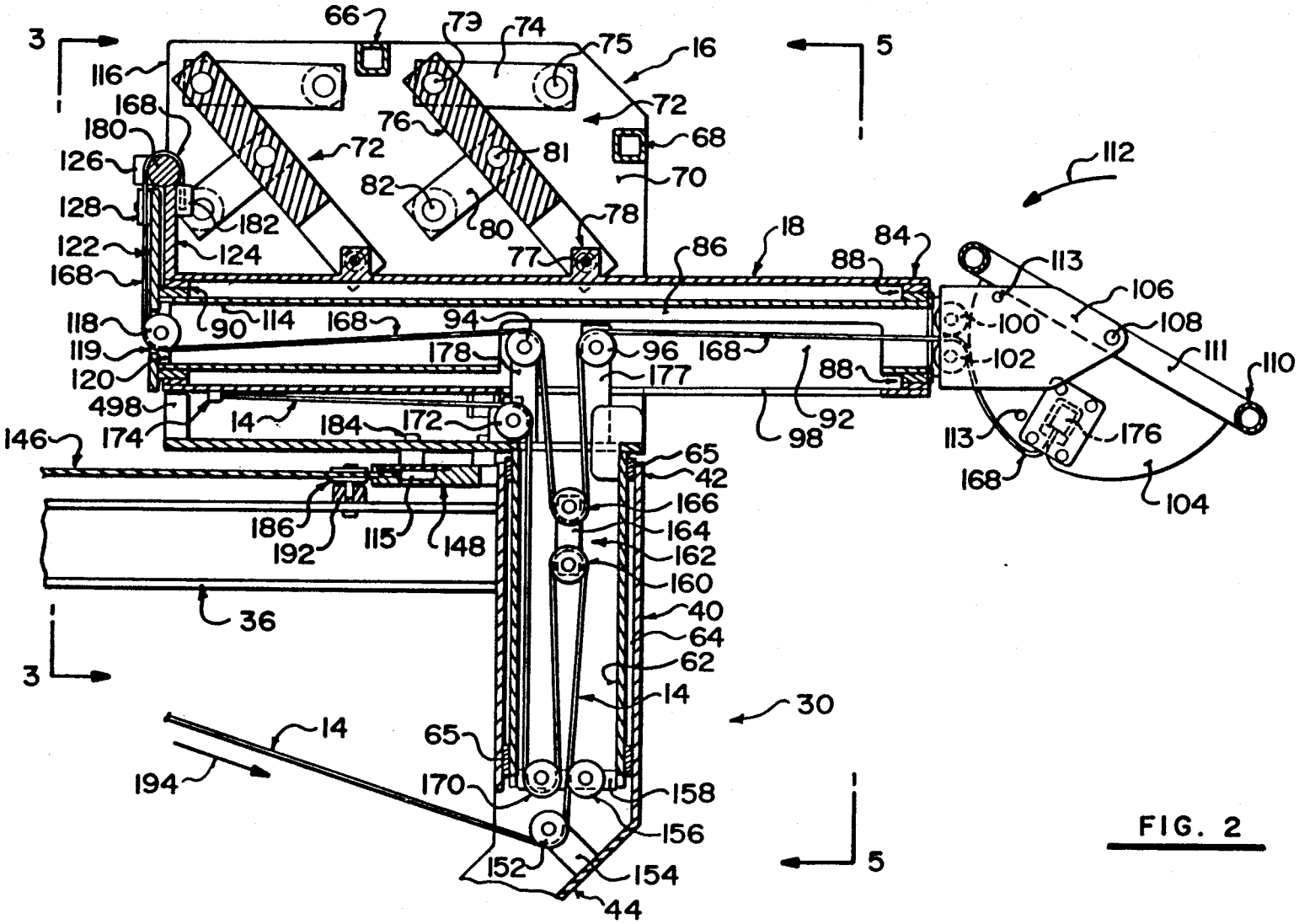
FIG. 2 is a side closeup view of a portion of the said apparatus showing the housing and extension.
Figure 5:
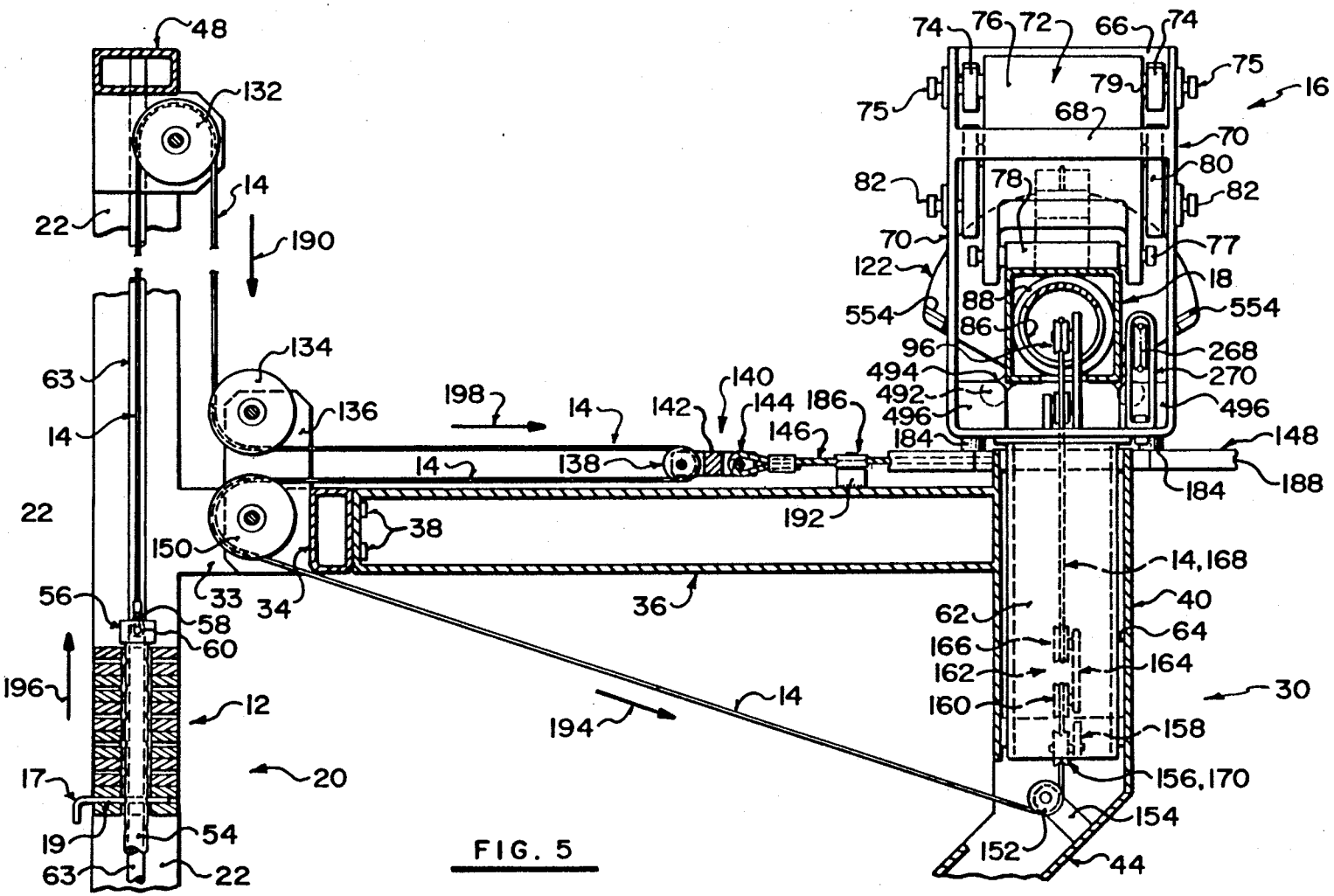
FIG. 5 is a side fragmentary view of a portion of the frame of the apparatus with the housing in a position perpendicular to the frame beam, taken along line 5—5 of FIG. 2.

Referring initially to FIGS. 1, 2 and 5, there is shown a testing, training and exercising apparatus generally designated 10 in FIG. 1, which incorporates the preferred embodiment of the present invention. Apparatus 10 includes a resisting force, which in this embodiment is weight stack 12 (FIG. 1), a resisting force connecting means, which in this embodiment is cable 14, a rotatable support means, which in this embodiment is a housing 16 and a force receiving means, which in this embodiment is movable extension 18. Weight stack 12 and the resisting force applied may be varied by selecting the desired member of individual weights and by placing locking pin 17 in the desired slot 19 to select the desired weight.

It should, however, be understood that a variety of force resisting means may be used. For example, individual weights, a spring or other resilient biasing means, pneumatic cylinder, tension belt wheel systems, motor driven resistance or magnetically controlled resistances may be employed. As well, various connecting means may be used, such as rope, wire, chain, belt, gears and connecting rods. Furthermore, as will be appreciated by one skilled in the art, various means for receiving force may be employed such as handles of varying shapes and orientation including those roughly shaped like a human body or parts thereof, pads, clothing, ropes, hoses, and the like.

Frame

Figure 12:
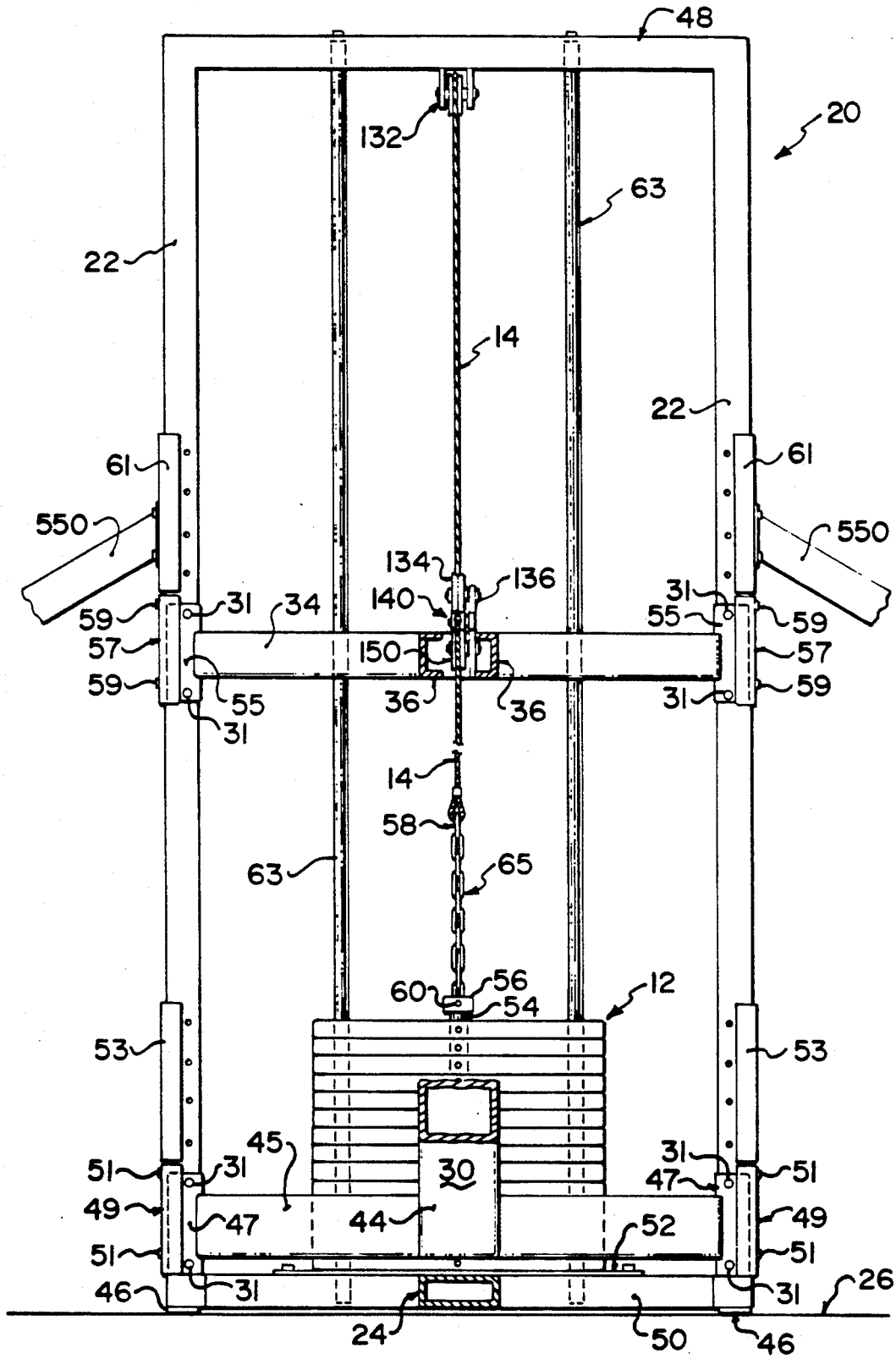
FIG. 12 is a front view of the frame and weight stack of the apparatus taken along line 12—12 of FIG. 10.

As seen best in FIGS. 1 and 12, frame 20 is rectangular in shape with two vertical side members 22 and top and bottom horizontal members 48 and 50. Channel 24 is attached to bottom member 50 and extends in a horizontal direction, perpendicular to frame 20. Referring to FIG. 1, channel 24 receives and supports strut plate 28 which is welded to angular support strut 30 and bolted to the top of channel 24. The other end of channel 24 is held against floor 26 by means of pin 32 which engages channel 24 and which extends into an opening (not shown) in floor 26. The opening may be a common existing gymnasium net post receptacle. Frame extension 33 extends laterally from each side member 22 of frame 20 at a distance which is about waist height for the average user. Frame extension 33 includes cross-member 34 extending horizontally across frame 20 to connect each side 22 of frame 20. Strut 30 is generally C-shaped and upper horizontal beam 36 of strut 30 connects to cross-member 34, approximately at the mid-point of extension 34 by means of bolts 38. Strut 30 also includes hollow vertical beam section 40 which includes upper support extension 42. Lower section 44 of strut 30 is attached to channel member 24 at its lower end.

An alternate means of attaching channel 30 to frame 20, which permits height adjustment of horizontal beam 36 with respect to floor 26, is shown in FIG. 12. Lower section 44 is attached to cross-strut 45 extending horizontally between side members 22. Each end of cross-strut 45 is connected to flange 47 which is slideably held adjacent side members 22 by means of removable securing flange 49. Flange 49 is secured to side members 22 by means of bolts 51. Strut 45 may be moved upwardly and downwardly with respect to frame 22 by removal of bolts 31 which permits flange 47 and strut 45 to move slideably between side members 22 and flange 49 upwardly or downwardly along side members 22. Rigidly secured flange 53 is rigidly attached to side members 22 and acts to slideably hold flange 47 against side members 22 when flange 47 is moved upwardly beyond removable securing flange 49.

Figure 13:
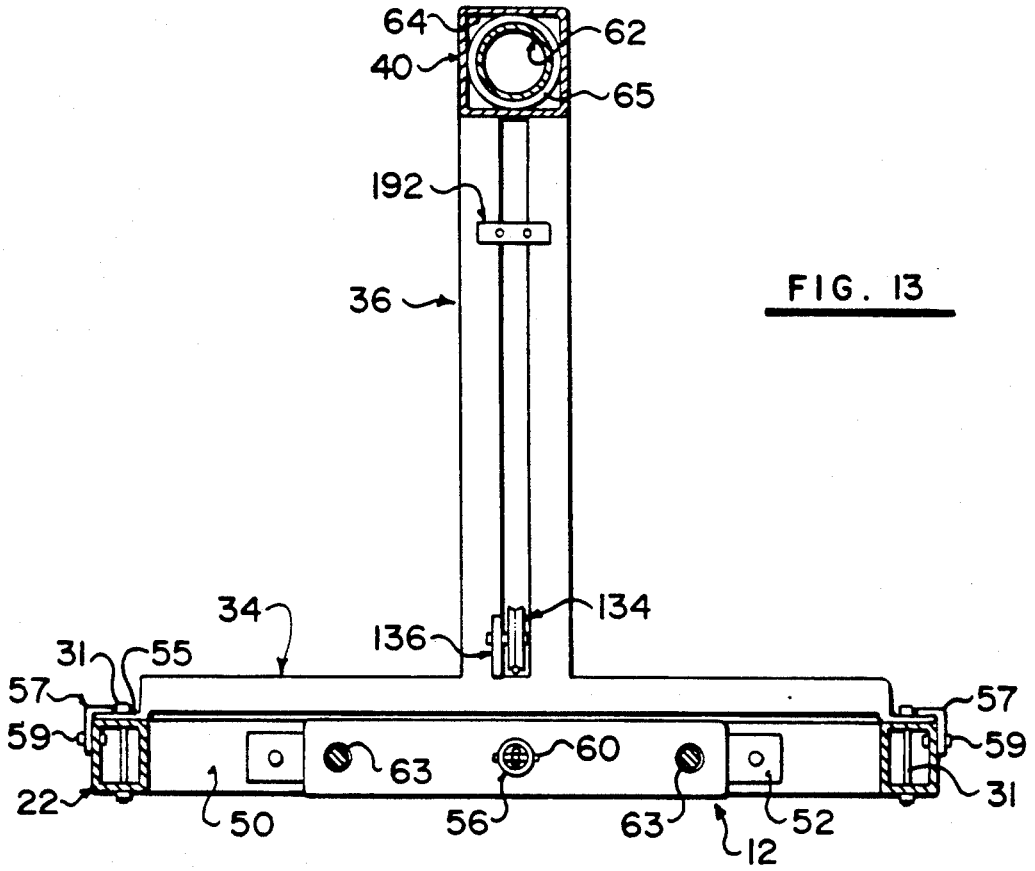
FIG. 13 is a top view of the frame and beam mechanism taken along line 13—13 of FIG. 10.
Figure 14:
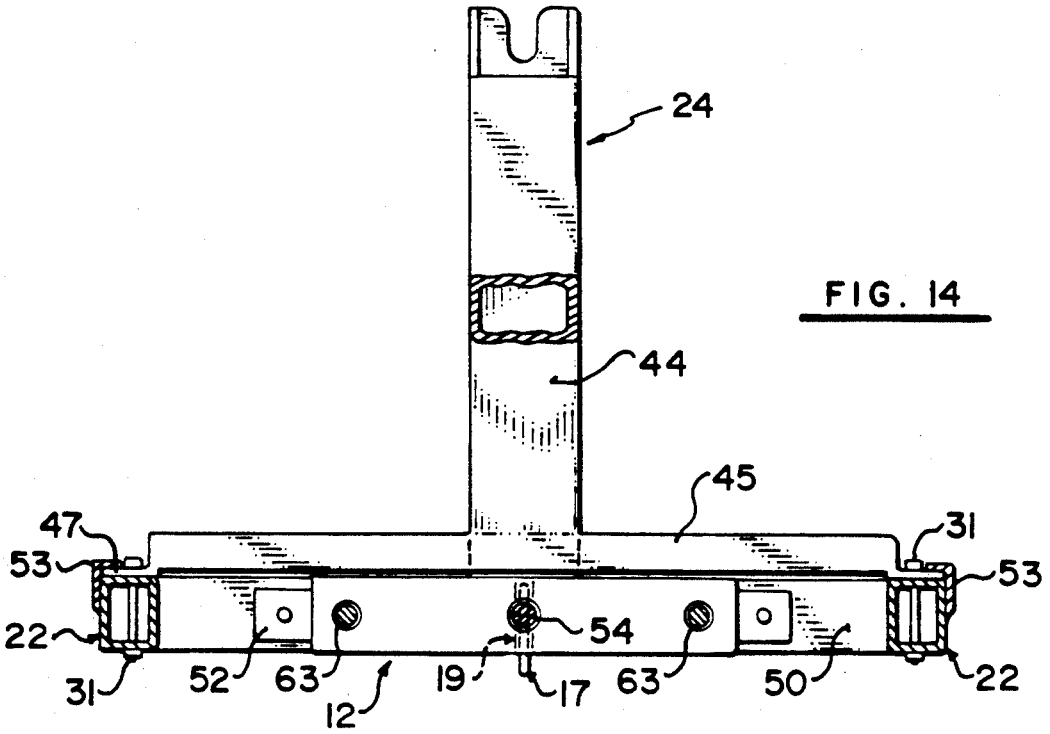
FIG. 14 is a top view of the lower frame mechanism with the perpendicular extension taken along line 14—14 of FIG. 10.
Figure 15:
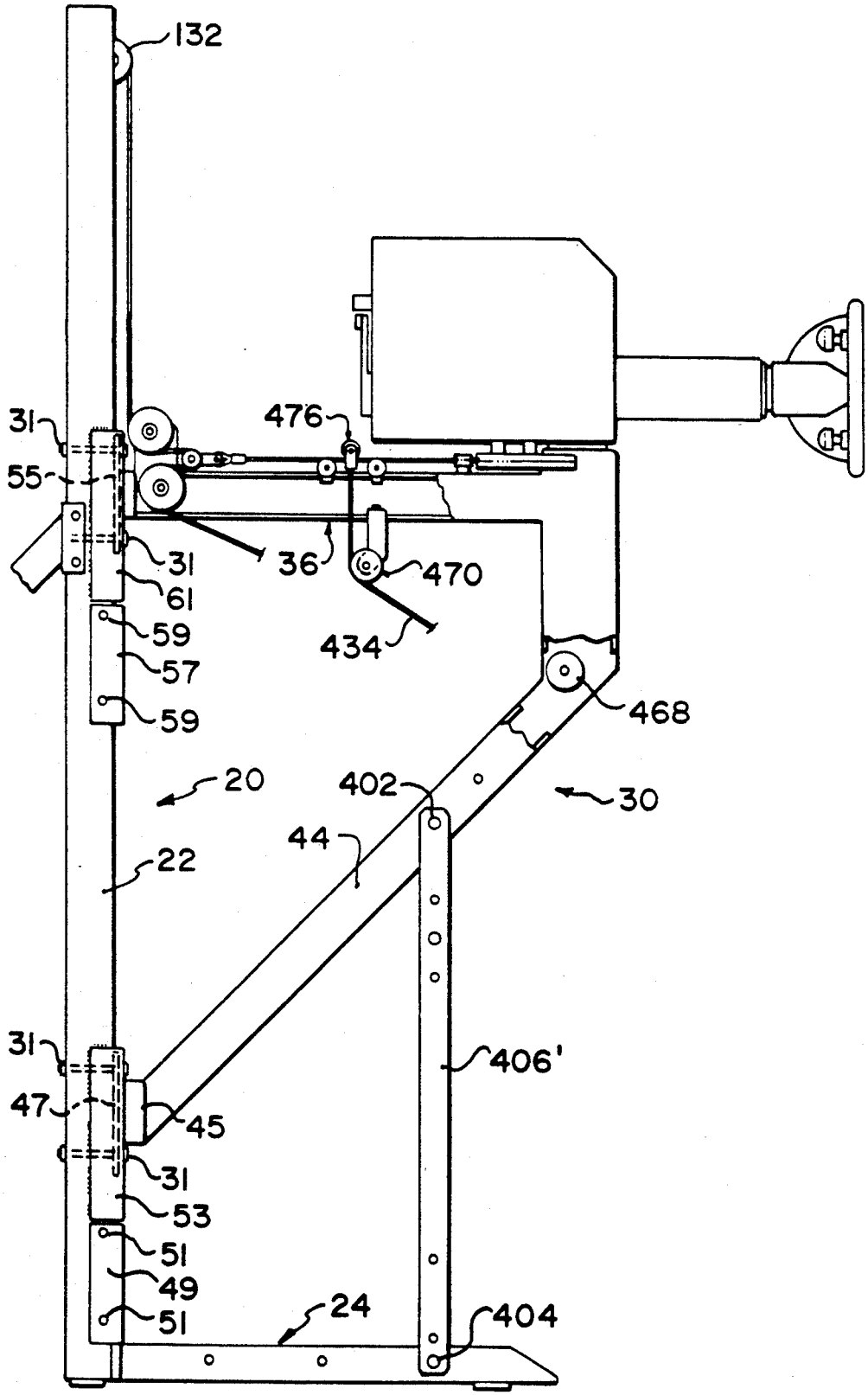
FIG. 15 is a side view of the apparatus showing the housing in a raised position with respect to the frame.

Similarly, cross-member 34 may be moved upwardly or downwardly a corresponding distance by means of flange 55 which is similar to flange 47 of cross-strut 45. Removable securing flange 57 is attached to side members 22 by means of bolts 59 to permit removal and attachment of support strut 30 to frame 20. Bolts 31 releasably secure flange 55 to slide members 22. When bolts 31 are removed, flange 55 is slideable between side members 22 and flange 57. Flange 61 permits further upward sliding movement of flange 55 against side member 22. Flange 61 is rigidly secured to side member 22. The height adjustment of support strut 30, with respect to frame 20, is also shown in FIGS. 13, 14 and 15. FIG. 15 shows support strut 30 in a raised position with respect to frame 20 with flanges 47 and 55 sandwiched between frame 20 and securing flanges 53 and 61 by means of bolts 31 and 31.

Frame 20 is supported by 3 floor protective foot pads 46 which hold frame 20 off the floor to allow securing nuts (not shown) to be attached and hold vertical guide rods 63 in position. Vertical guide rods 63 extend between top member 48 and bottom member 50 of frame 20. Each guide rod is adjacent to and parallel with respective side member 22. A stack of weights 12 (FIG. 1) rests on a weight receiving pad 52 attached to bottom member 50, the stack of weights is held and guided in position within frame 20 by vertical guide rods 63. A user may select the desired weight 12 (resistance force) by placing weight selecting pin 17 into the desired weight 12 and through downwardly extending rod 54. The upper end of rod 54 is attached to the cable 14 by means of weight contact plate 56 and cable attachment ring 58. Cable 14 is attached to ring 58 by pin 60. Optionally, as shown in FIG. 12, removable chain link section 65 may be interposed between cable 14 and pin 60 to permit adjustment of the distance between these points to lengthen or shorten the length of cable 14 and section 65 when height adjustment is made.

Referring to FIGS. 1 and 2, housing 16 is rotatably attached to strut 30 by means of shaft 62 which extends co-axially through bearing sleeve 64 located in section 40 of strut 30. Bearing sleeve 64 is journalled longitudinally and vertically into section 40 and receives shaft 62 for rotatable motion of housing 16 in a horizontal plane about the top of strut 30 and is positioned for rotation above beam 36 and is supported by upper support extension 42. Bearings 65 (FIG. 2) retain shaft 62 within sleeve 64 and permit rotational movement of the sleeve within the shaft. Housing 16 is welded, substantially at its forward end, to the upper end of shaft 62 and rotates in the sleeve.

Push Action on Extension

Housing 16 will now be described with reference to FIGS. 2 and 5. Housing 16 is generally constructed in the shape of a "U" with a upper brace member 66 and lower brace member 68 supporting sides 70 at the upper, open end of the housing. Extension 18, which acts as a force receiving extension, is movably connected to housing 16 for slideable movement of extension 18 along its longitudinal axis in the direction of arrow 71 of FIG. 1.

In one design, extension 18 is connected to housing 16 by a pendulum swing means, in this embodiment a pair of yokes 72. Yokes 72 include upper member 74 rotatably connected to housing 16 by means of pin 75. The other end of member 74 is connected to vertical support member 76 at one end of member 76 by pin 79. The other end of member 76 is rotatably connected to the top of extension 18 by means of pin 77. Pin 77 extend through extension support bar 78 to support extension 18 in housing 16. Lower member 80 is connected to an intermediate portion of member 76 by pin 81 at one end of member 80. The other end of member 80 is rotatably connected to housing 16 by pin 82.

As can be seen in FIGS. 1 and 2, extension 18 is movable from a rest position in which first or outer end 84 of extension 18 extends its maximum distance from housing 16 (FIG. 2) to a retracted position in which end 84 extends a minimal distance from housing 16 (FIG. 1). Yoke 72 are shown in the corresponding extended position in FIG. 2 and the retracted position in FIG. 1. Yoke 72 permits horizontal movement of extension 18 from the said extended position to the said retracted position, within housing 16.

Thus as outer end 84 of extension 18 is pushed toward housing 16, member 76 beings to swing around pin 77. Movement of extension 18 is held in a relatively horizontal plane by the action of member 80 supporting member 76 causing upper member 74 to swing upward at pin 79. Thus as extension 18 is moved through housing 16 to its retracted position the traverse is relatively horizontal due to the support of lower member 80 on member 76.

Extension 18 is limited in movement by stops 492 which contact stop plate 498 when extension 18 is moved to its fully retracted position. Stops 492 also prevent movement of extension 18 outwardly beyond a pre-determined rest position by striking a stop plate 496. Stops 492 are attached to extension 18 by flange 494.

Extension 18 is completely self-contained in housing 16 and thereby rotates in a horizontal plane above beam 36 with rotation of housing 16, irrespective of the position and movement of extension 18 within housing 16.

Referring to FIGS. 1 and 5, the extension push action cable and pulley system will now be described using weight 12 as the starting point. Cable 14 extends upward within frame 20 around pulley 132 attached to the underside at the center of top member 48 of frame 20. Cable 14 extends upward and over pulley 132 and then downward, outside of frame 20, to engage pulley 134 which is rotatably attached to the top of upper horizontal beam 36 by means of support 136. Cable 14 then extends about pulley 134 horizontally to engage pulley 138 of floating pulley system 140.

Floating pulley system 140 includes connecting member 142 (FIG. 5) with pulley 138 rotatably attached at one end and clevis 144 attaching cable 146 at the other end. Cable 146 is used together with cam 148 to control rotational movement of housing 16 about its vertical axis, as described in more detail below.

Cable 14 extends around pulley 138 and returns towards frame 20, in a horizontal direction, to engage pulley 150. Pulley 150 is rotatably attached to support 136. Cable 14 then extends outwardly and downwardly from pulley 150 in a direction away from frame 20 to engage pulley 152 rotatably attached to the inside of lower section 44 by means of support 154. Pulley 152 engages cable which extends upward from pulley 152 substantially adjacent to the axis of rotation of housing 16. Cable 14 extends upward to engage pulley 156 rotatably connected to the inside wall of shaft 62 by means of support 158. Pulley 156 centres cable 14 along the central axis of shaft 62. Cable 14 then extends upward to engage and encircle pulley 160 of floating pulley system 162.

As seen in FIGS. 1, 2 and 5, pulley system 162 includes connecting member 164 having pulley 160 rotatably attached to the bottom end and pulley 166 attached at the top end. Pulley system 162 floats in that it is supported solely by cable 14 and cable 168 and moves upwardly and downwardly within shaft 62, as will be discussed in greater detail below. Cable 14 then extends downwardly from pulley 160 to engage pulley 170 rotatably connected to the inside wall of shaft 62 opposite pulley 156. Cable 14 then extends upwardly to engage pulley 172 rotatably attached to housing 16 by a support 173). Cable 14 then extends horizontally towards frame 20 just below extension 18 and the end of cable 14 is rigidly secured to the underside of the rear portion of extension 18 by clamp 174.

Rope Pull

Figure 6:
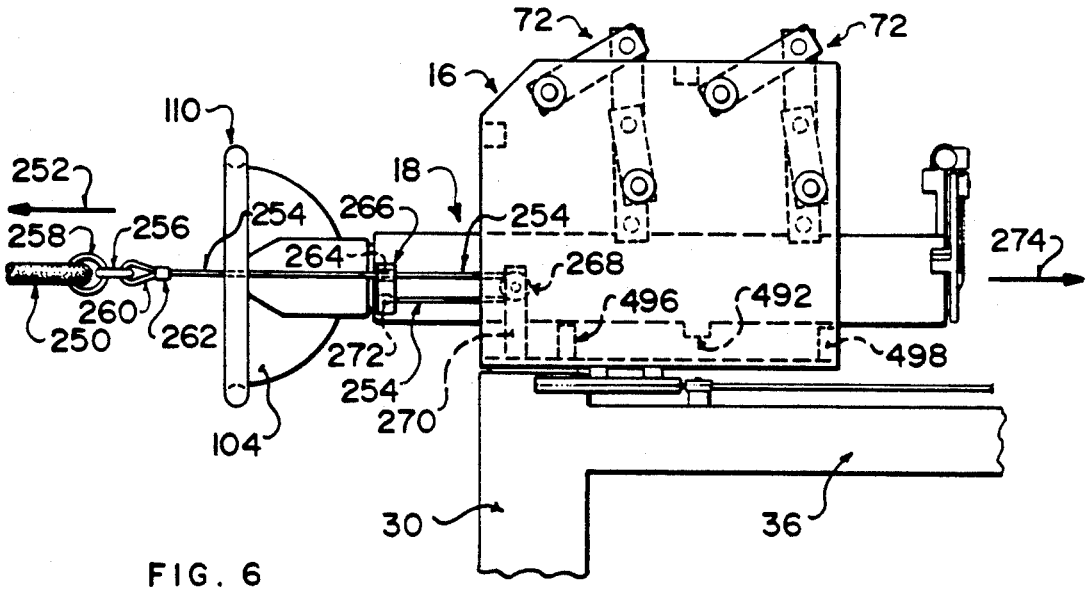
FIG. 6 is a side view of the housing and extension showing the use of the grip rope to pull to cause force to be applied against the resisting force.
Figure 7:
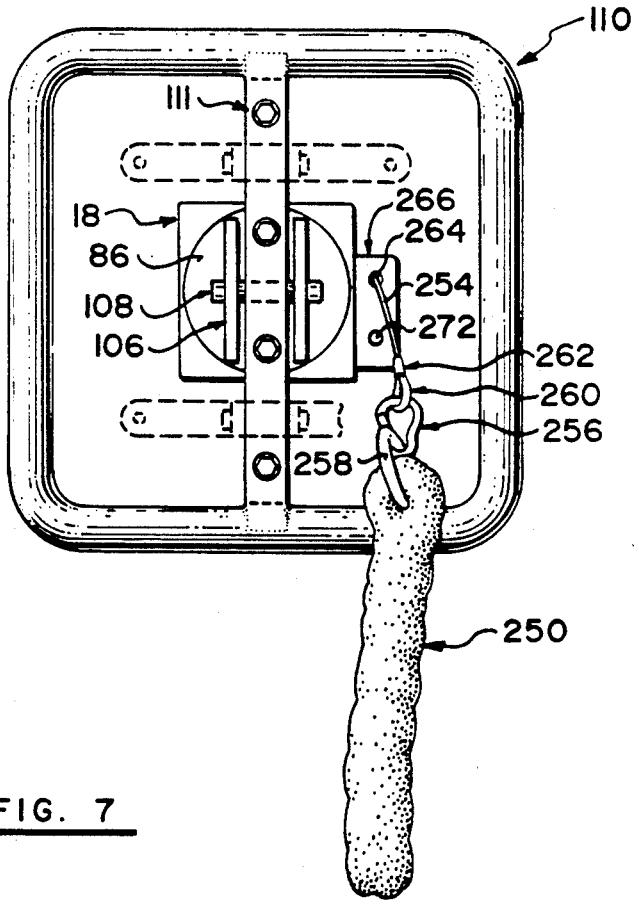
FIG. 7 is a front view of the handle portion and rope grip portion of the apparatus.

Referring to FIGS. 6 and 7, force may be applied against cable 14 to lift weights 12 by pull action on rope handle 250 in the direction of arrow 252. Handle 250 is connected to cable 254 by means of ring member 256 attached to ring 258 at one end and to cable loop 260 at the other. Cable loop 260 is formed by crimp 262. Ring 258 is, in turn, connected to an end of handle 250. Cable 254 extends through an opening 264 in guide flange 266. Flange 266 is attached to extension 18. Cable 254 then extends and loops about pulley 268 rotatably attached to housing 16 by means of support 270. Cable 254 then loops about pulley 268 and returns to flange 266 and is secured to flange 266 by means of securing means 272.

It will be seen that pull action on handle 250 in the direction of arrow 252 will cause cable 254 to pull on securing means 272 by applying pulling pressure in direction of arrow 274. This will cause extension 18 to also move in the direction of arrow 274 thereby pulling cable 14 which is secured to extension 18 by means of clamp 174 (shown in FIG. 1). This causes weights 12 to be lifted in the direction of arrow 196.

Twist Rotation of Extension

Referring to FIG. 2, extension 18 has a tubular coaxial sleeve 86 extending longitudinally through extension 18. Sleeve 86 is rotatably attached to arm 16 by means of twist bearings 88 and 90 at each end of sleeve 86, adjacent corresponding ends of extension 18. Sleeve 86 is a hollow pipe through which certain connecting cables pass. Portion 92 of the bottom half of the front end of sleeve 86 has been cut away to permit horizontal movement of sleeve 86 with extension 18, without interfering with pulleys 94 and 96. Similarly, portion 98 of the bottom half of outer end 84 of extension 18 has been cut away. Portion 92 extends about the extended part of sleeve 86 to permit sleeve 86 to rotate without contacting pulleys 94 and 96.

Figure 3:
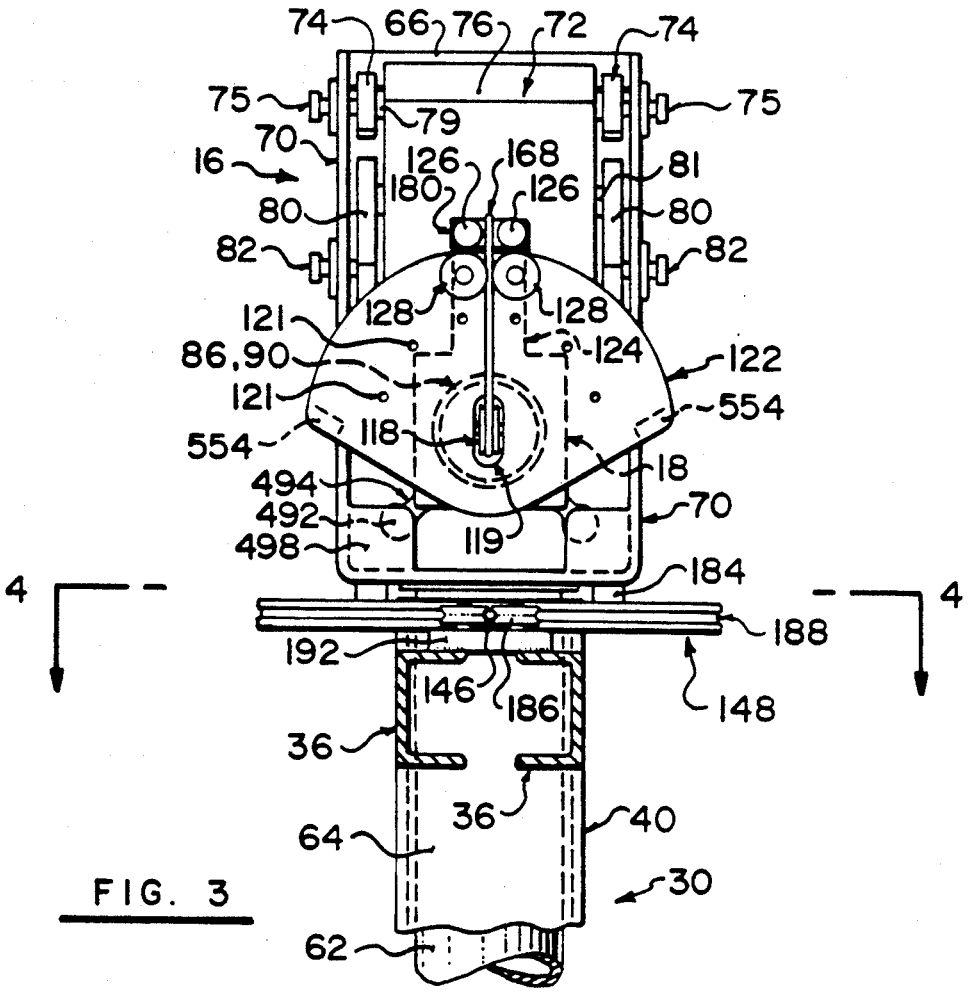
FIG. 3 is a rear view of a portion of the extension and housing taken along line 3—3 of FIG. 2.

When extension 18 is in its rest position, as shown in FIG. 2, rear end 114 of sleeve 86 extends slightly beyond the corresponding rear end 116 of housing 16. Pulley 118 is rotatably attached in a vertical plane to end cap 120 of sleeve 86. Cam 122, (best seen in FIGS. 3 and 17) which is generally semi-circular in shape, is attached laterally to end cap 120 and extends upward adjacent rear flange 124 attached to extension 18. Rear flange 124 includes lateral extension 126 which extends just above the outer periphery of cam 122, in a rearward direction. As shown in FIG. 3, cam 122 includes a pair of pulleys 128 adjacent the outer periphery of cam 122 with cable 168.

Referring to FIGS. 2 and 3, the operation of cam 122 which engages cable 168 and thereby cable 14 on twisting rotation of sleeve 86 in extension 18, will now be described. Cam 122 is attached to end cap 120 of sleeve 86 and extends laterally and upwardly therefrom. Cam 122 is shaped generally in the form of a half circle and is attached so that the circular portion is facing upward with the triangular portion downward. Pulley 118 is aligned with the center of cam 122 when cam 122 is in its rest position with the center of housing 16 aligning with the center of cam 122. Pulley 118 maintains cable 168 in an aligned position with the center point of cam 122 irrespective of the twisting rotation of sleeve 86 with respect to extension 18. Pulley 118 also ensures alignment of cable 168 between pulleys 128 and also with pulley 94 Pulley 118 is located adjacent opening 119 in cam 122 and directs cable 168 through opening 119.

As best seen in FIG. 3, pulleys 128 are attached the outer periphery of cam 122 to engage cable 168 on rotation of sleeve 86 with respect to extension 18. It can be seen that portion of 168 extending over holding bar 180 (FIG. 2) is fixed by crimp means 182. Similarly, pulley 118 will maintain cable 168 at a position generally adjacent the center point of cam 122. Consequently, on twisting rotation of sleeve 86, one of pulleys 128 will engage cable 168 thereby pulling cable 168 to raise pulley system 162 upwardly, thereby pulling cable 14 and lifting weight 12.

Cable 168, connecting pivot movement of handle 110 and twist movement of sleeve 86 in extension 18, will now be discussed with particular reference to FIG. 2. One end of cable 168 is attached to cam 104 at cable crimp means 176. Cable crimp means 176 is located generally along the centre line of cam 104 such that cable 168 extends horizontally from means 176 when handle 110 is in a rest position as shown in FIG. 1 and so that cable 168 engages alternate segments of cam 122 when handle 110 is selectively twisted in either direction. Cable 168 engages pulleys 128 when handle 110 is pivoted in either direction, as depicted in FIG. 3.

Cable 168 extends into sleeve 86 and is kept centered by pulleys 100 and 102 and extends longitudinally therethrough to engage pulley 96. Pulley 96 is rotatably attached to housing 16 on the inside lower surface by support 177, positioned so that cable 168 will extend downward within bearing sleeve 64 to engage pulley 166 of system 162. Cable 168 extends downward and around pulley 166 and then upward to engage pulley 94 which is rotatably attached to housing 16 on the inside lower surface by support 178. Pulleys 94 and 96 are positioned inside open portion 92 of sleeve 86 and guide cable 168 inside sleeve 86. Pulley 94 is positioned at similar height to, but opposite, pulley 96. Cable 168 then extends toward end 114 within sleeve 86 to engage pulley 118 and pass upward adjacent cam 122 between adjacent sets of pulleys 128. Pulleys 128 guide cable 168 up between lateral extensions 126 and over directional holding bar 180 to be secured by cable crimp means 182 attached to upright flange 124. In this way, one end of cable 168 is securely affixed to extension 18.

As seen best in FIGS. 2 and 3, twisting movement of sleeve 86 about its longitudinal axis, within extension 18, will cause cable 168 to engage one of pulleys 128 thereby applying pulling pressure on cable 168 to lift pulley system 162 upwardly thereby pulling cable 14.

Securing holes 121 are positioned at appropriate points about the circumference of cam 122 and also in rear flange 124. Locking pin (not shown) is provided to engage in aligning holes to affix sleeve 86 in a pre-determined position with respect to extension 18 when aligning holes 121 of cam 122 align with corresponding holes in flange 124. In this way, extension 86 may be fixed in several pre-determined positions from the rest position with respect to extension 18.

Handle Pivot

Referring to FIGS. 2 and 7, sleeve 86 extends beyond outer end 84 of extension 18 and supports attached pulleys 100 and 102 and cam 104. Cam 104 is pivotably attached to sleeve 86 by means of extending flange 106. Bolt 108 of handle 110 pivotably support handle 110. Cam 104 is attached, and rotates with, handle 110. Cam 104 is semi-circular in shape with a grooved outer periphery to hold a cable therebetween. Handle 110 rotates forward and backward from a vertical rest position, that is, pivotal motion in the direction of arrow 112 (FIG. 2) and in the opposite direction.

Referring to FIGS. 2 and 7, cam 104 will now be described. Cam 104 controls the pivot of handle 110 about bolt 108. Cam 104 is attached to handle 110 at the outer end of rotatable sleeve 86 by vertical center bar 111 which is centered within handle 110. Cam 104 is shaped as a half circle with a diameter of approximately 12 inches. Cam 104 rotates about the geometric center of the handle system on bolt 108. Cam 104 is cut and circularly bevelled inward at either side of the midpoint on the circumference of the cam to form a channelled groove (not shown) to receive cable 168 therebetween. Cable 168 is secured to cam 104 by crimp means 176. Pulleys 100 and 102 are attached to sleeve 86 and maintain cable 168 directly aligned with the outer groove of cam 104 throughout any combined rotation of cam 104 and twisting of sleeve 86 relative to the movement of extension 18 in housing 16. Cable 168 is kept adjacent the surface of the outer circumference of cam 104 by the said channelled groove (not shown), which is substantially equal to the diameter of cable 168. A locking pin (not shown) may be removably inserted through the aligned cam holes 113 at a user determined angle of handle 110 to lock the pivotal movement of cam 104 at a fixed desired vertical angle relative to its rest position When a locking pin is not inserted in holes 113, cam 104 is free to pivot with handle 110 to pull cable 168 about the circumference of cam 104.

Housing Rotation

Figure 4:
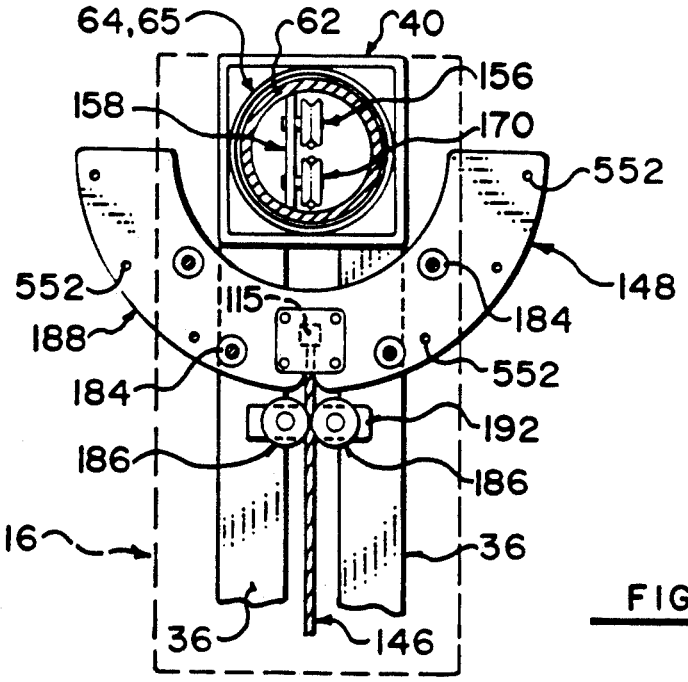
FIG. 4 is a top view of a portion of the housing and extension arm showing the rotation control cam, taken along line 4—4 of FIG. 3.

Referring to FIGS. 1, 2, 4 and 5, the rotation of housing 16 and the control of that rotation by cam 148 will now be described Cam 148 controls the horizontal rotation of housing 16 about its vertical axis. As extension 18 is connected to housing 16 by yokes 72, this also causes rotation of extension 18. Cam 148 is best seen in FIG. 4 and is similar in construction to cam 104. Cam 148 is attached to the underside of housing 16 by means of extensions 184 with the outer semi-circular portion of cam 148 facing frame 20 when housing 16 is in its rest position, as depicted in FIGS. 1 and 2. Cable 146 is connected to crimp means 115 (FIG. 4) at the center of cam 148, in a similar manner as with cam 104. A pair of pulleys 186 keep cable 146 in alignment with groove 188 about the outer circumference of cam 148. Pulleys 186 are connected to beam 36 by support 192. Support 192 remains stationary upon rotation of housing 16. Pulleys 186 also keep cable 146 adjacent the center position of cam 148 when housing 16 is in the said rest position. As previously discussed, cable 146 is attached to floating pulley system 140 which is movably connected to cable 14 by pulley 138. As will be readily apparent, horizontal rotation of housing 16 will cause cable 146 to be pulled into groove 188 about cam 148 thereby pulling cable 146 and causing cable 14 to be moved in direction of arrow 190 to lift weights 12. FIG. 5 illustrates the movement of (FIG. 1) housing 16 to a position perpendicular to beam 36 and resultant pulling action on cables 146 and 14.

Dummy

Figure 10:
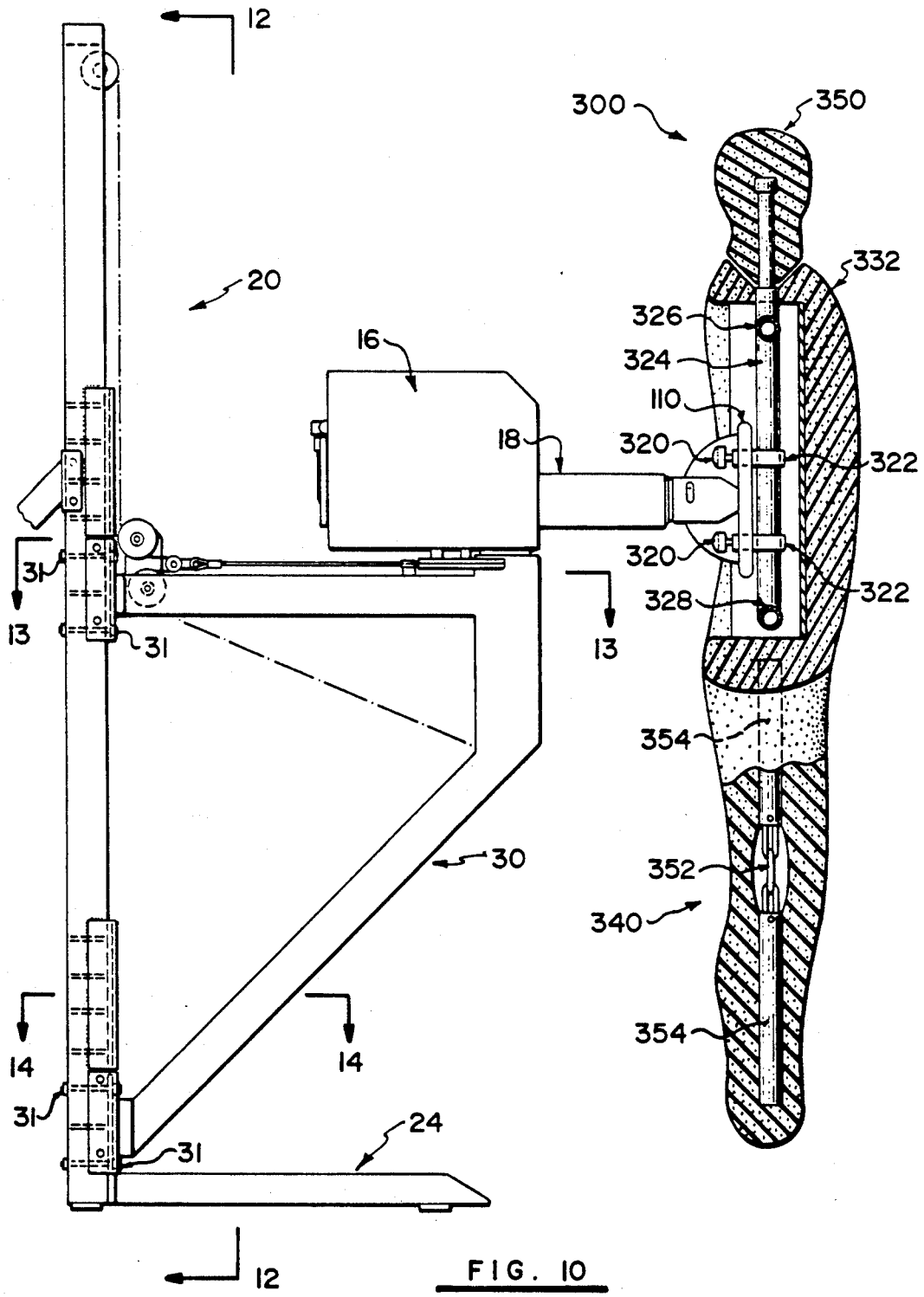
FIG. 10 is a side view of the apparatus showing the attachable dummy affixed to the handles and showing the alternate height adjustment of the frame.
Figure 11:
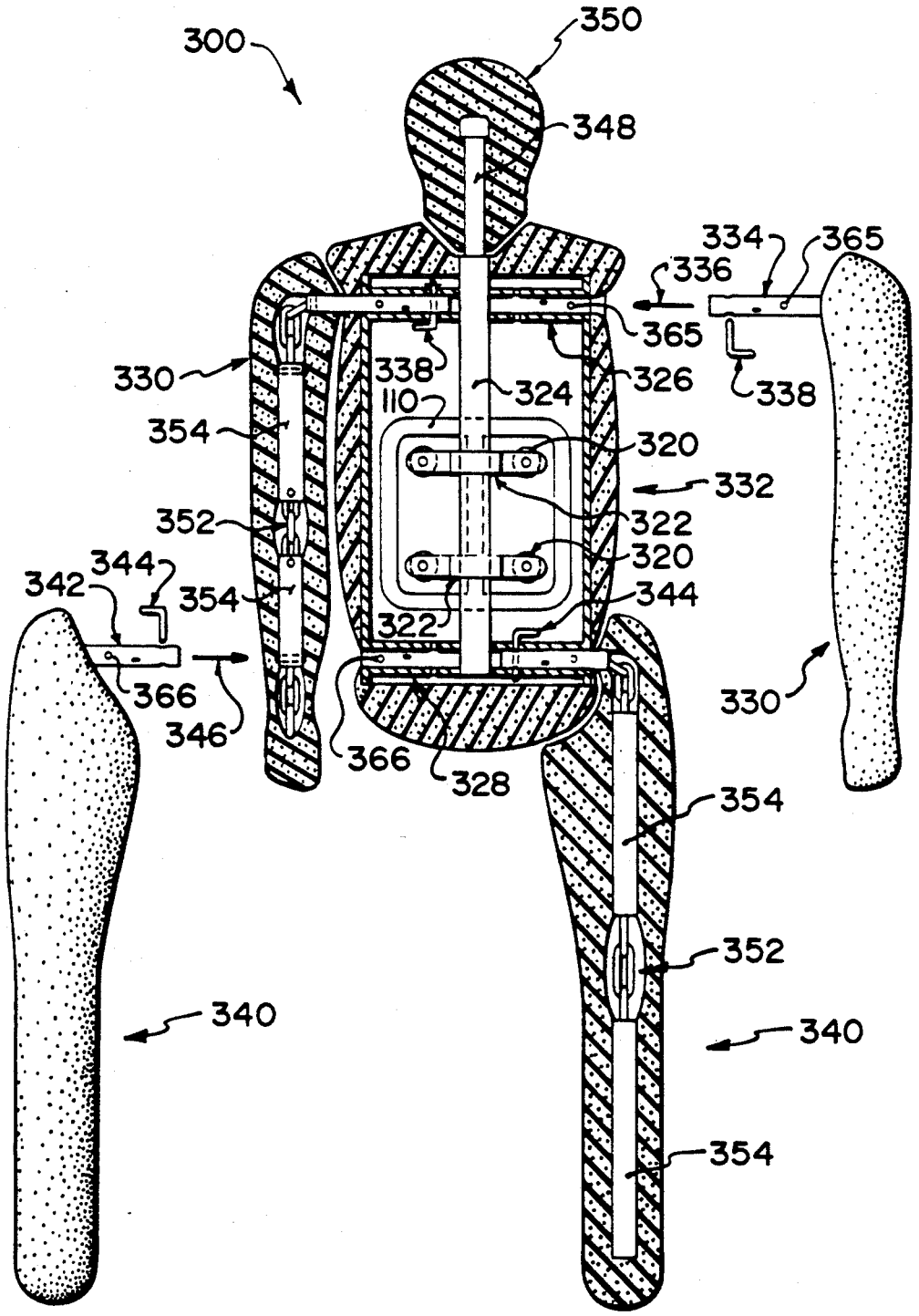
FIG. 11 is a frontface view of the dummy with some parts separated.

FIGS. 10 and 11 illustrate the optional attachment of a lifesize padded force receiving dummy 300. Dummy 300 is removably attached to handle 110 by clamps 322 which are held together by four screw locks 320. Clamps 322 secure vertical pipe 324 which forms the support for dummy 300. The distance of dummy 300 from floor 26 may be adjusted by selectably securing pipe 324 by means of clamp 322 at the appropriate position along pipe 324. Upper cross-pipe 326 extends laterally from an upper portion of pipe 324 and lower cross-pipe 328 extends from a lower portion of pipe 324. Upper pipe 326 is used to secure arms 330 to dummy body portion 332. Lateral insert pipe 334 extends laterally from arm 330 and may be inserted into pipe 326 in the direction of arrow 336 as depicted in FIG. 11. Pin 338 may be positioned through openings in pipes 326 and 334 to secure arm 330 to body portion 332.

Similarly, lower pipe 328 supports legs 340 of dummy 300. Lower lateral insert pipe 342 may be inserted into pipe 328 to be secured by means of pin 344 by movement of lateral pipe 342 into pipe 328 in the direction of arrow 346.

Pipe 324 also includes upper extension member 48 extending upwardly therefrom. Member 348 may be moved upwardly or downwardly to adjust the position of head 350 with respect to body portion 332. Arms 330 and legs 340 may be pivoted at the elbow and knee segments by means of chain link members 352 connecting upper and lower pipe members 354.

All limb pipes are threaded at their ends to receive a cap (not shown) which allows the limb to swing freely but not slip out of the receiving pipe. Each of pipes 334 and 342 have several drilled holes 365 and 366 into which locking pins 338 and 344 may be placed, so as to allow the user to place limbs independently at various angles for training purposes Arms 330 are constructed of a combination of rubber and pipe where the rubber is heated, extruded and bonded (vulcanized) onto the pipe forming a secure bond. Within the shoulder, elbow and wrist joints are placed three chain links 352 to strengthen and control the bending and rotation of these joints. Similarly, legs 340 are constructed using the same process at the hip and knee joints. Head 350 is constructed using extension 348 as the base which is removably screwed into the torso cavity using standard threaded pipe fittings. Each body part joining the torso is bevelled to fit into the torso so the potential for contact injury with metal is remote. Portion 332, arms 330 and legs 340 and head 350 of dummy 300 are covered with resilient foam at the consistency and density of human flesh. Additional protection can be attached to any part of dummy 300 using covered foam parts (not shown) velcroed into place. Further, electrical buzzers (sound device) can be selectively connected at strategic points within the dummy for body contact confirmation.

A-Frame

Figure 8:
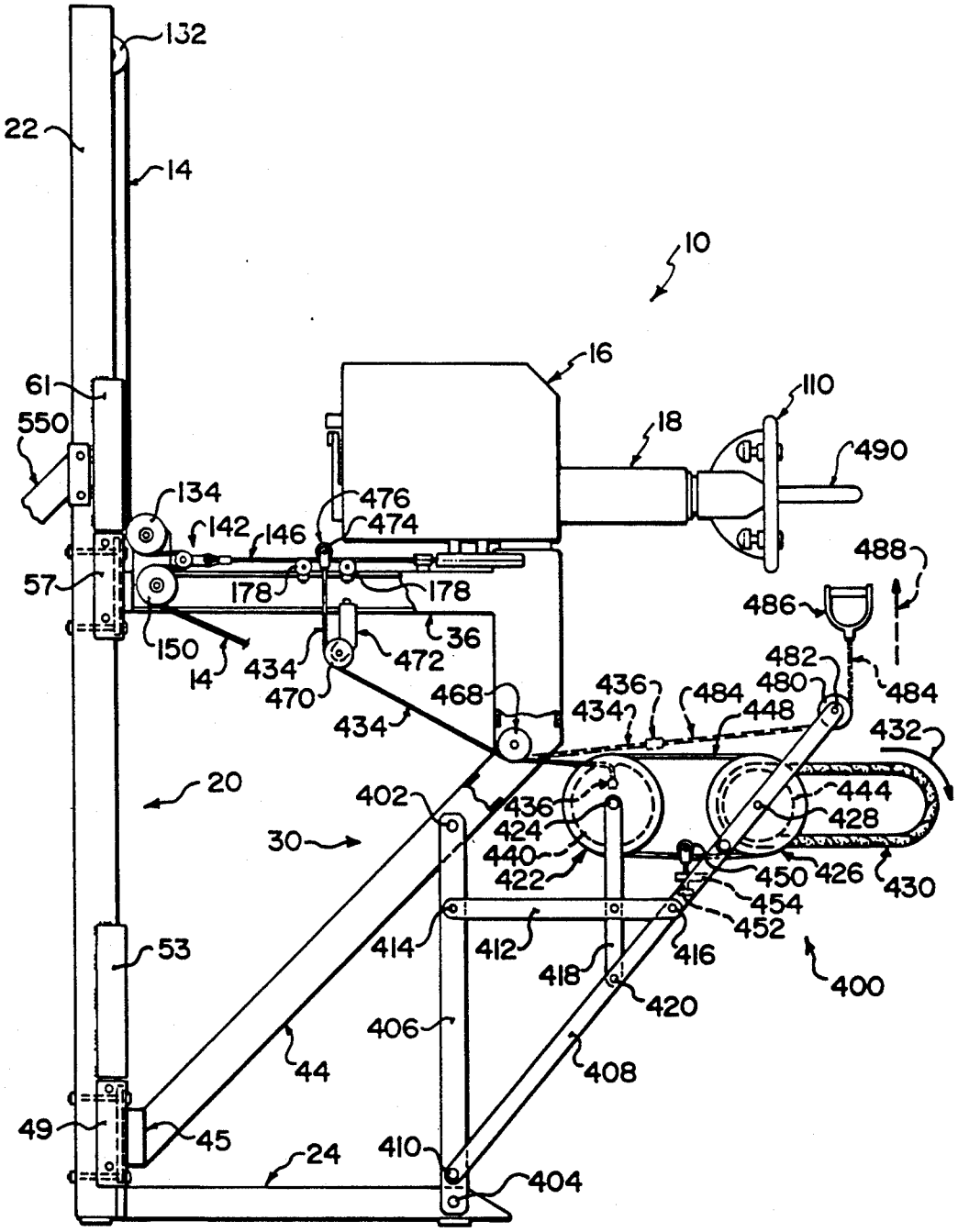
FIG. 8 is a side view of the apparatus showing the A-frame mechanism and having the stretcher lift and push mechanism shown by broken line.
Figure 9:
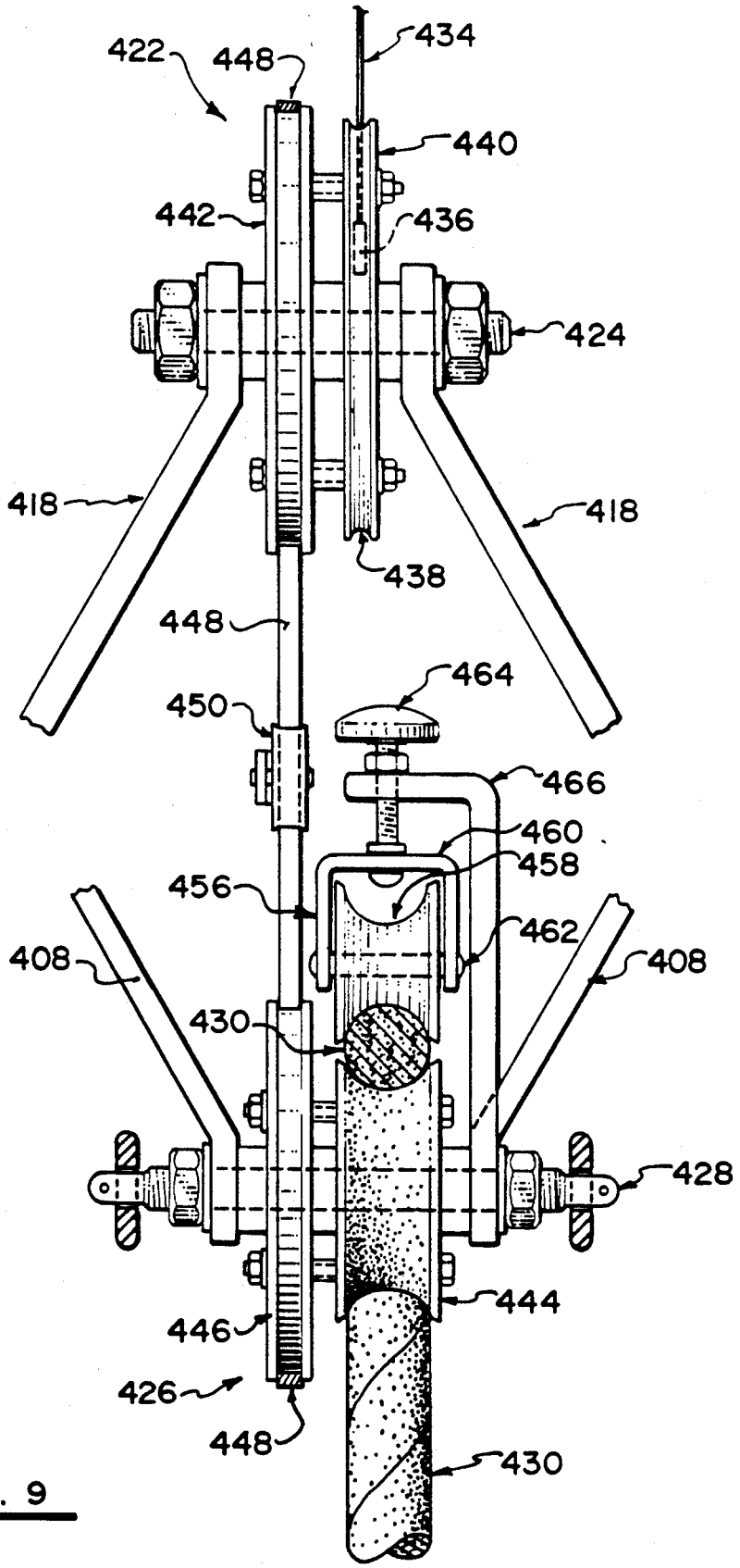
FIG. 9 is a closeup view of the friction belt and rope pull mechanism of the A-frame assembly of FIG. 8.

Referring to FIGS. 8 and 9, the "A" frame attachment will now be described This attachment is generally used to provide rope pulling training and exercise and, alternatively, to provide lifting training and exercise. "A" frame structure 400 is removably attached to section 44 of strut 30 and to member 24 by bolts 402 and 404. Bolts 402 and 404 support beam member 406 which extends between member 24 and section 44. As seen in FIG. 15, alternate beam member 406' may be substituted for beam member 406 as height adjustment to strut 30 is made in the manner previously described.

Referring to FIG. 8, angular support arm 408 extends upwardly and outwardly from member 406 and is attached to member 406 by bolt 410 adjacent the lower end of beam 406. Arm 408 is held in position by lateral arm 412 extending from beam 406 in a horizontal orientation. Arm 412 is attached to beam 406 adjacent an upper end of beam 406 by bolt 414 and is attached to arm 408 at a position adjacent a centre portion of arm 408 by means of bolt 416. Tension wheel support arm 418 is attached to arm 408 at its lower end by bolt 420. Tension wheel 422 is rotatably attached to the upper end of arm 418 by means of axle member 424.

Second tension wheel 426 is rotatably attached to arm 408 adjacent an upper portion of arm 408 by means of axle member 428. Second tension wheel 426 has circular rope member 430 attached thereto for pulling by a user in the direction of arrow 432, or in the opposite direction, to cause force to be applied to lift weights 12 (FIG. 1). Cable 434 has one end attached to cable attachment wheel 440 by means of attachment member 436. Tension wheel 422 has outer circumferential groove 438 (FIG. 9) for receiving cable 434 therein upon rotation of tension wheel 422.

As best seen in FIG. 9, tension wheel 422 includes cable attachment wheel 440 in coaxial alignment with resistance wheel 442. As well, tension wheel 426 incorporates rope attachment wheel 444 in coaxial alignment with corresponding resistance wheel 446. Resistance wheels 442 and 446 are interconnected by belt 448, the tension of which may be adjusted by tightening pulley 450 against the inner portion of belt 448 by turning screw member 452 into flange 454 (FIG. 8).

Tension may be applied against rope member 430 by tension application wheel 456 having bevelled surface 458 for contacting rope 430 and for permitting tensioned sliding of rope 430 between bevelled surface 458 and wheel 444. Wheel 456 is rotatably attached to support member 460 by pin 462. Adjustment of wheel 456 with respect to rope 430 in order to vary tension on rope 430 is provided by screw 464 attached to flange 466. Flange 466 is attached to axle 428.

Cable 434 extends from attachment member 436 and contacts outer groove surface of pulley 468 which is attached coaxially with pulley 152 Cable 434 then extends upwardly and inwardly towards frame 20 to contact pulley 470 attached to beam 36 by means of support 472. cable 434 then extends upwardly and is connected to attaching member 474 having pulley 476 rotatably attached thereto. Member 474 includes slot opening (not shown) permitting pulley 476 to engage the upper side of cable 146. In this way, cable 434 may be removably attached to cable 146 when the user wishes to operate "A" frame 400 to cause weights 12 (FIG. 1) to be lifted. When "A" frame 400 is not used, it can be removed from apparatus 10 by removal of bolts 402 and 404 and removal of pulley 476 from cable 146.

Pulling action on rope 430 in the direction of arrow 432 will cause rotation of wheel 444. This, in turn, will cause rotation of wheel 446 to move belt 448 which causes rotation of wheels 442 and 440. Rotation of wheel 440 pulls cable 434 about the outer circumference of wheel 440 in groove 438 thereby pulling cable 434 and cable 146. Cable 146 is pulled between supporting pulleys 178. This pulling action on cable 146 causes corresponding pulling action on cable 14 attached to cable 146 by means of member 142. Pulling action on cable 14 causes lifting of weights 12, as best seen in FIGS. 1 and 5. Pulley 470 is located a pre-determined distance from pulley 476 when on cable 146, which is approximately equal to the circumference of wheel 440. This permits movement of pulley 476 from the rest position shown in FIG. 8 to a position adjacent pulley 470 when wheel 440 is turned approximately one rotation.

Thus when force is applied to rope 430, wheel 444 turns with resistance wheel 446. Depending on the tension within belt 448 caused by pulley 450, tension wheel 442 will turn equal to the resistance connected to the that tension wheel through resistance wheel 440. Once this resistance has been overcome belt 448 slips on resistance wheels 442 and 446 allowing the wheel 446 to continue to rotate by force being applied by rope 430.

Referring to FIG. 8, the alternate lifting training option will now be described. Pulley 480 is rotatably attached to the upper end of arm 408 by bolt axle 482. Attachment member 436 is removable from wheel 440 and is attachable to the end of cable 484. The other end of cable 484 is attached to handle 486. Cable 484 extends about pulley 480. Upward pulling force on handle 486 in the direction of arrow 488 will cause pulling action on cable 434 attached to cable 484 by means of attachment member 436. Pulling action on cable 434 will cause corresponding pulling action on cable 146, and on cable 14, all as previously described. This will cause weights 12 (FIG. 1) to be lifted.

In this way, the user can simulate the force required to, for example, lift a stretcher. As well, when used in conjunction with extension 490 attached to handles 110, the user can apply lifting force in the direction of arrow 488 by lifting handles 486 and also pushing force by pushing on extension 490 to cause extension 18 to move into housing 16 and thereby applying force to lift weights 12, as previously described. This simulates the lifting of a stretcher and pushing of that stretcher into a vehicle, for example.

Alternate Embodiments

Alternate embodiments of the present invention will now be discussed with particular reference to FIGS. 16, 17, 18, 19 and 20. The first alternate embodiment relates to an alternative means for supporting the extension in the housing to permit the extension to move laterally within the housing on its longitudinal axis. The second alternate embodiment relates to an alternative means of engaging and pulling the cable to cause force to raise the weights when the housing is rotated about the vertical axis of its shaft. In the figures, those elements which are commons between the alternate embodiments and the previously described embodiment are numbered the same with the addition of "0.1" or "0.2" (for components shown in an alternative position by broken line).

Unique components have been given a unique number without the addition of any decimal.

Figures 16, 17:
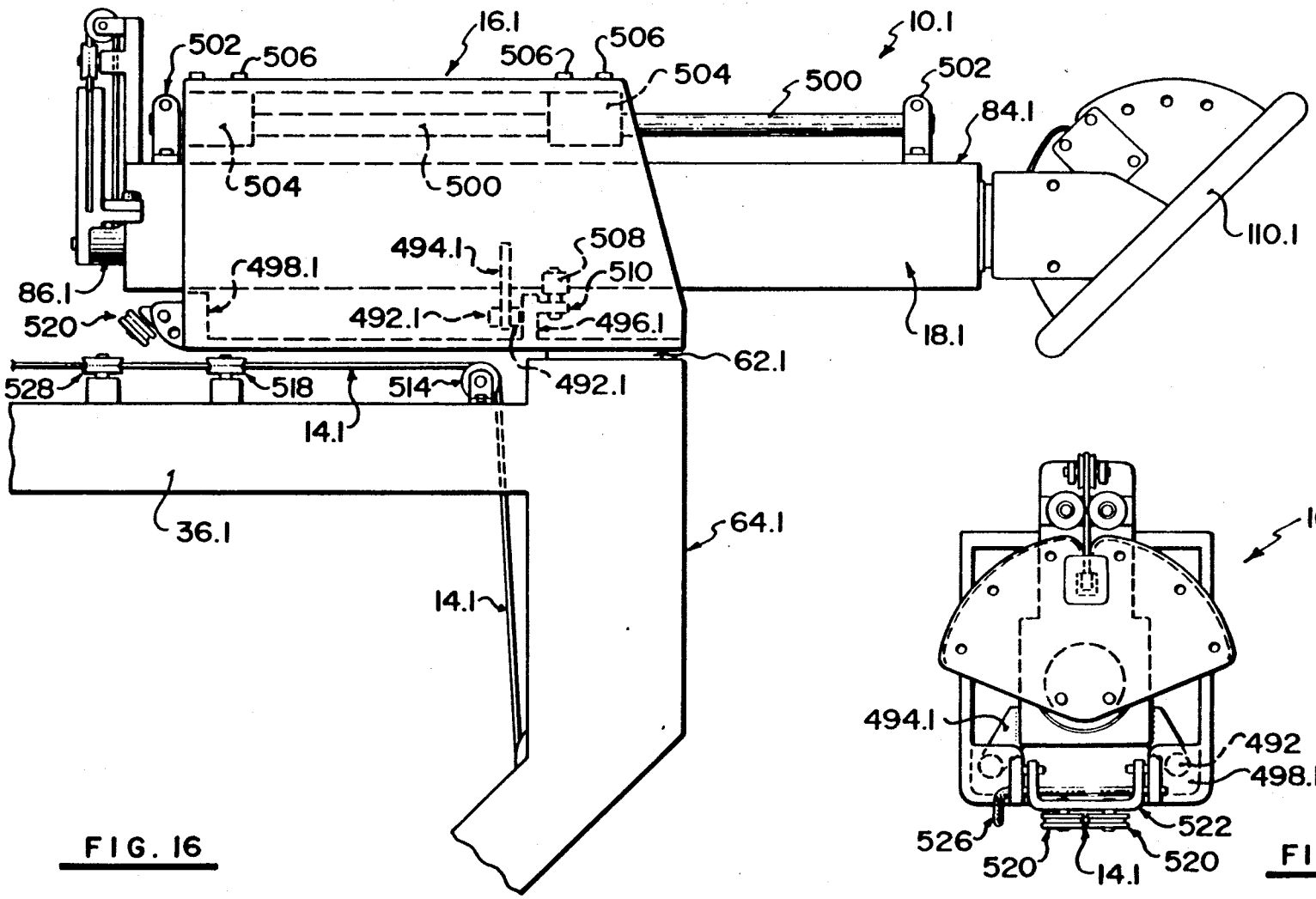
FIG. 16 is a side view of a portion of the frame housing and extension of an alternate embodiment of the testing, training and exercise device having a bushing rod for connection of the extension to the housing.
FIG. 17 is a rear view of the housing and extension of the alternate embodiment of FIG. 16.

Referring initially to FIG. 16, apparatus 10.1 is shown with extension 18.1 extending from and supported by housing 16.1. Housing 16.1 is rotatable about a vertical axis of attached shaft 62.1. Shaft 62.1 is supported by beam 36.1 which, in turn, is attached to frame (not shown).

Extension 18.1 is connected to housing 16.1 for lateral horizontal movement of extension 18.1 along its longitudinal axis within housing 16.1, by means of bushing rod 500. Bushing rod 500 is secured to the upper portion of extension 18.1 by bushing rod supports 502. One bushing rod support 502 is connected to outer end 84.1 of extension 18.1 and the other bushing rod support 502 is connected to extension 18.1 at an inner end of extension 18.1. A pair of linear ball bushings 504 are connected in linear alignment to housing 16.1 by means of bolts 506. Rod 500 extends through longitudinal openings in bushings 504. Bushings 504 include ball bearings (not shown) to slideably support bushing rod 500 within bushings 504 to permit horizontal movement of extension 18.1 within housing 16.1 between an extended position (shown in FIG. 18) and a retracted position (not shown), similar to the retracted position shown in FIG. 1.

Figure 18:
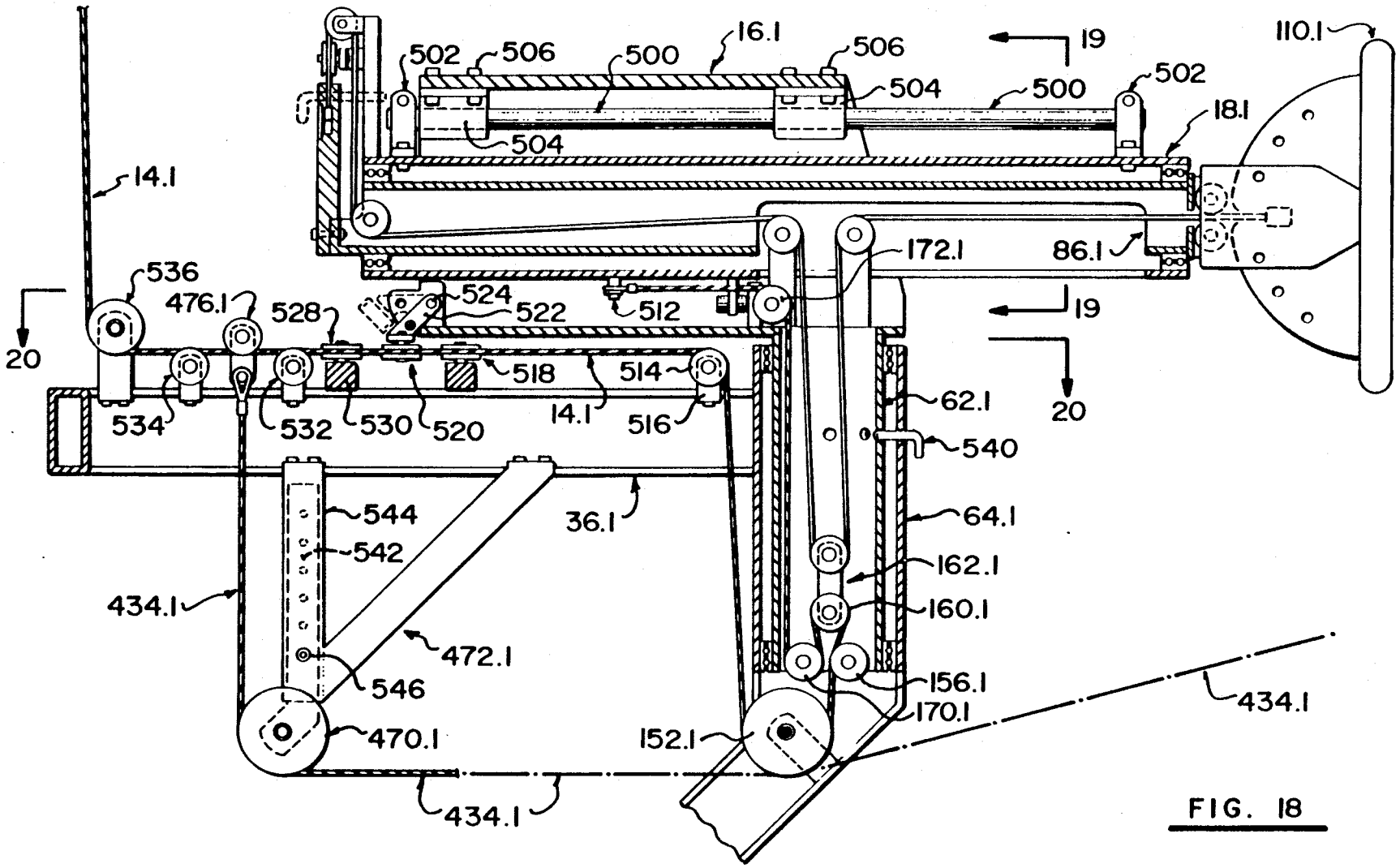
FIG. 18 is a side view of the extension, housing and frame of the alternate embodiment of FIG. 16.

As shown in FIG. 18, a pair of rubber stops 492.1 are attached to extension 18.1 by means of flange 494.1. Stops 492.1 serve to restrict lateral horizontal movement of extension 18.1 in housing 16.1 between the front stop plate 496.1 and rear stop plate 498.1.

Figure 19:
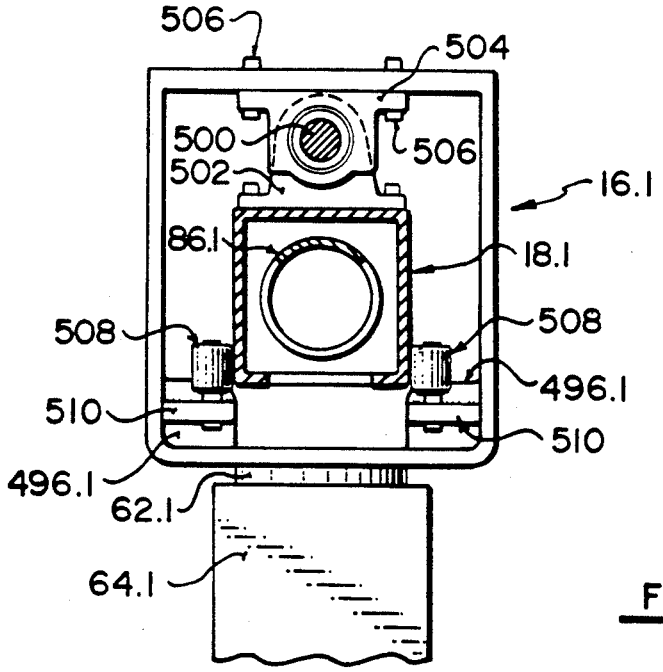
FIG. 19 is a front sectional view of a portion of the housing and extension of the alternate embodiment of FIG. 16 showing the stabilizing guide wheels.

Referring to FIGS. 16 and 19, a pair of guide wheels 508 are rotatably attached to guide wheel flange 510. Glide wheel flange 510 is attached to front stop plate 496.1 of housing 16.1. Guide wheel flanges are oriented to sandwich opposed vertical walls of extension 18.1 as best depicted in FIG. 19. This prevents a sideward pendelum swing motion of extension 18.1 about the axis of rod 500 and serves to stabilize extension 18.1 when sleeve 86.1 is rotated about its longitudinal axis.

Figure 20:
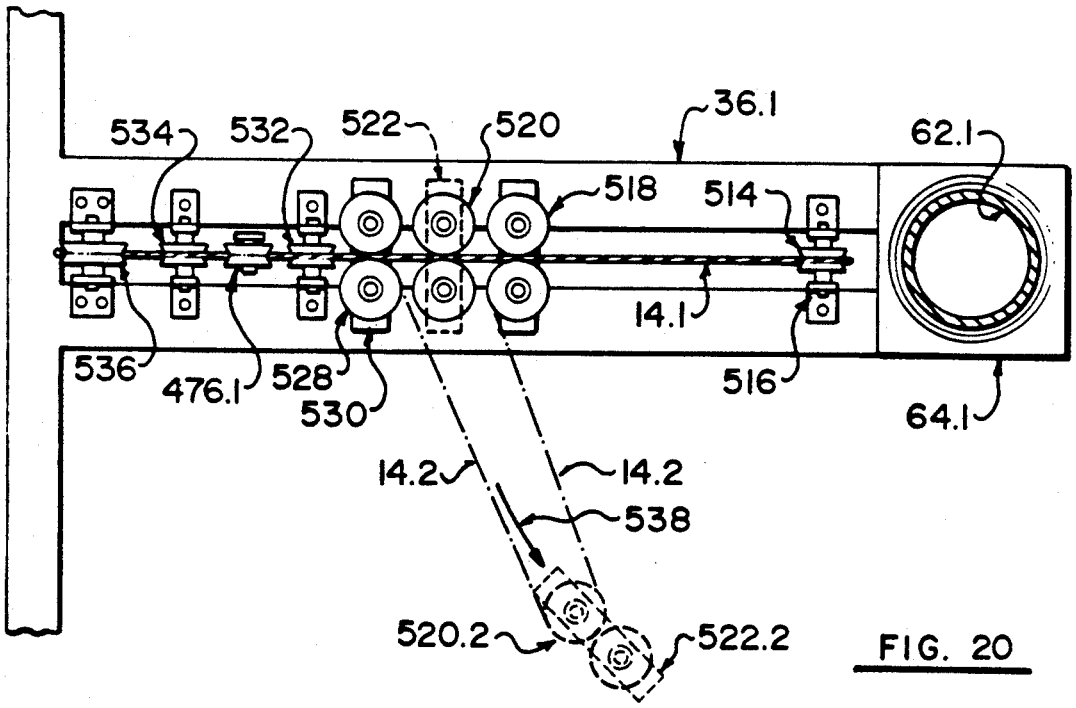
FIG. 20 is a top view of the pulley system along the frame beam of the alternate embodiment of FIG. 16.

FIGS. 17, 18 and 20 will now be referred to in discussing an alternative embodiment for gripping cable 14.1 when housing 16.1 is rotated about the axis of shaft 62.1, and thereby pulling cable 14.1, which, in turn lifts weights (not shown).

Cable 14.1 is connected at one end to the lower portion of extension 18.1 by means of connector 512. Cable 14.1 then extends perpendicular to extension 18.1 to engage pulley 172.1 and then downwardly within shaft 62.1 perpendicular to the longitudinal axis of shaft 62.1 to engage pulley 170.1. Cable 14.1 then extends upwardly to engage pulley 160.1 of pulley system 162.1. Cable 14.1 then extends downwardly to engage pulley 156.1 and then down to pulley 152.1. Cable 14.1 then wraps around pulley 152.1 and extends upwardly to engage pulley 514 connected to beam 36.1 by support 516. Cable 14.1 then extends horizontally to engage and pass between pulley pair 518 which sandwich cable 14.1 between them. Cable 14.1 then extends between pivoting pulley pair 520 which are pivotably attached to housing 16.1 by means of support 522 which is pivotable about axis pin 524 between a lowered position, as shown by a solid line in FIG. 18, and a raised position shown by a broken line in FIG. 18. When in the lowered position, pulley pair 520 engage cable 14.1 when housing 16.1 is pivoted about the axis of shaft 62.1. Removable pin not shown may be inserted into corresponding opening to secure pivot support 522 in either the lowered or raised position. Cable 14.1 then passes between pulley pair 528 attached to beam 36.1 by pulley support 530. Cable 14.1 then passes the top portion of pulley 532 and the lower portion of removable pulley 476.1 of "A" frame attachment (shown in FIG. 8). Cable 14.1 then passes above pulley 534 and then engages and passes about the lower portion of pulley 536. Cable 14.1 then extends upwardly to engage and wrap about pulley 132 in the conventional manner as described with the initial embodiment and as shown in FIG. 1. Cable 14.1 then is attached to weights (not shown) as previously described. Pulley pairs 528 and 518 serve to prevent lateral movement of cable 14.1 on pivotable movement of housing 16.1 about the axis of shaft 62.1, to enable pulleys 520 to pull cable 14.1 to lift the weights This is best depicted in FIG. 20 where the pulling action of pulleys 520 is shown in broken line which shows movement of housing 16.1 and pulleys 520.2, in the direction of arrow 538. It will be seen pulley pairs 518 and 528 restrict lateral movement of cable 14.1 upon such rotational movement of pulleys 520 in the direction of arrow 538 to enable pulleys 520 to properly pull cable 14.1 and thereby lift weights (not shown).

In this embodiment, rotational movement of housing 16.1 about the vertical axis of shaft 62.1 may be restricted by use of pin 540 which engages openings in bearing sleeve 64.1 and sleeve 62.1 to prevent rotational movement of sleeve 62.1 in bearing 64.1.

FIG. 18 also depicts an alternative support 472.1 of pulley 470.1 of the "A" frame apparatus shown in FIG. 8. Support 472.1 is adjustable and includes inner extension member 542 which is slideable within vertical section 544 of support 472.1. Removable pin 546 secures extension 542 at a pre-determined selected extended or retracted position with respect to vertical member 544. This permits adjustment of the distance between beam 36.1 and pulley 470.1 and thereby extends the distance between cable 14.1 and pulley 470.1 to permit sufficient length of cable 434.1 between cable 14.1 and pulley 470.1. This permits the user to adjust this length in accordance with the circumference of wheel 440 to enable pulley 476.1 to pull cable 14.1 in a downward direction as wheel 440 is rotated approximately one revolution.

OPERATION

Apparatus 10 allows a user to be tested, to train or to exercise using a machine that will simulate functional and realistic work requirements, specific sport activities and abilities and allow the user to follow flexible and progressive training and exercise programs to meet and surpass work and sport expectations. The apparatus allows a user to train against a simulated opponent which is able to be pushed, pulled and rotated on three separate axes of rotation all of which can be moved independent of the other or in any or all combined functional and realistic movement directions of the body. The user is able to measure current physical capabilities and progressively train toward projected physical abilities. The user can set the level of resistance to reflect various testing, training or exercise regimes. The user may select various options, as discussed below, depending on the muscle groups or abilities for which testing, training or exercise are desired. The user positions him/herself adjacent apparatus 10 in order to effectively apply pulling, pushing, rotational and pivoting forces, in any combination, on the various components of apparatus 10.

Apparatus 10 is also useful in measuring and determining minimal acceptable physical abilities of an individual. As examples, one may test a person's ability to pull a fire hose, or a pre-determined resistance, over a pre-determined distance or time, or test a person's ability to apply and control resisting forces such as are experienced by police officers in arresting and controlling suspects, or the ability of a ambulance person to lift and carry a pre-determined weight on a simulated stretcher handle and simulate walking with the stretcher pushing it into an ambulance from various positions, or the ability of a football lineman to apply force against the force receiving dummy a pre-determined number of times within a given time period at a given resistance force amount, or the ability of a police officer to measure and train self defense and control skills against a simulated suspect presenting realistic and varying levels of resistance.

Apparatus 10 is also useful to those who treat and rehabilitate physical injuries as apparatus 10 enables the user to apply progressive levels of force using specifically selected injured muscle groups of the user associated with and reflecting functional and realistic work or sport requirements.

The basic operation of apparatus 10 will now be described with reference to the figures. The user of the apparatus must decide the testing, training or exercise protocol or regimen that is to be performed. The user may employ designed stop or limiting mechanisms to fix the rotational movements or the arm 16 or choose to attach or detach connective cables as needed to conduct a particular test, training or exercise regime. Further, the user must decide the appropriate force receiving device to be used, these include objects, such as a dummy 300 attached to handle 110, or grasping objects such as a fire hose nozzle or rope, continuous rope 430 or lifting and carrying handle systems like handle 486 and the like. The user must select the level of resistance to be applied against the user by selecting the number and weight of weights 12 by inserting weight selection pin 17 in the selected weight. The apparatus may be positioned in an open unrestrictive area for use throughout the rotation of arm 16 by securing apparatus 10 to the floor using floor mount pin 46 or may be positioned against a solid structure such as a wall using the support beams 550 shown in FIGS. 8, 10, 12 and 15.

The basic operation of apparatus 10 will now be considered with reference to FIGS. 1, 2 and 5. As an option, apparatus 10 may include adjustable strut 30 which may be raised in height with respect to the support surface 26, thereby permitting the positioning of handle 110 at a pre-determined height. The length of extension 18 is such that the outer end 84 protrudes from the outer end of housing 16 about eighteen inches which is about one-half the length of the average adult male arm length. This is approximately the initiating distance of any application of force being applied by a user.

Pushing

Pushing action on handle 110 will now be described with reference to FIGS. 1 and 2. At rest, with weights 12 at a lowered position, supported only by frame 20, cable lengths are adjusted such that extension 18, with respect to housing 16, is extended from housing 16 in a rest position, as depicted in FIG. 2. In this position, stop 492 of extension 18 is adjacent front stop plate 496 of housing 16. When the user applies pushing force on handles 110, in the direction of arrow 71 (FIG. 1) extension 18 moves horizontally towards frame 20 by pivoting action of yokes 72. When extension 18 is pushed to the fully retracted position, as shown in FIG. 1, stop 492 of extension 18 strikes rear stop plate 498 of housing 16 and extension 18 is thereby prevented from further retractive movement. Because cable 14 is secured to extension 18 at clamp 174, movement of extension 18 in the direction of arrow 71 will cause movement of cable 14 in the same direction pulling cable 14 in the directions of arrows 194, 190 and 196, thereby lifting the pre-selected weight 12 upward in the direction of arrow 196. Lifting of weights 12 provides resistance against movement by the user of handles 110 in the direction of arrow 71.

Pulling

Referring to FIGS. 6 and 7, the user may also elect to cause movement of extension 18 in the direction of arrow 71 by pulling on rope 250 in a direction opposite to arrow (FIG. 1) 70 to pull cable 254 about pulley 268. This will pull extension 18 in the direction of arrow 71 causing cable 14 to be pulled in the same direction and in the direction of arrows 194 and 190 (FIG. 1). This also will lift weights in the direction of arrow 196 (FIG. 1) causing resisting force to be applied against the pulling force of the user.

Rotation

The user may also apply force against the resisting force by applying pivotal force on handles 110 in either direction to cause housing 16 to rotate about its vertical axis by causing rotation of shaft 62 within bearing sleeve 64. Housing 16 is shown in its rest position, being parallel with beam 31, in FIG. 1 and in a right angle position in FIG. 3. Application of rotational motion to move housing 16 from the position in FIG. 1 to the position in FIG. 5, causes cam 148 to turn in the same direction as housing 16. This pulls on cable 146, wrapping cable 146 in the groove about the periphery of cam 148. Pulling action on cable 146 will pull pulley system 140 in the direction of cam 148. As seen in FIG. 5, this causes pulling action on cable 14 in the directions of arrows 198 and 190 (FIG. 5). This causes weight 12 to be lifted against gravity in the direction of arrow 196 thereby applying resisting force against rotational movement of housing 16. This horizontal rotation of housing 16 may occur in either direction from the rest position depicted in FIGS. 1 and 2. Horizontal rotation may be restricted by placement of locking pin (not shown) into aligning holes 552 (FIG. 4) between housing 16 and cam 148. Self-centering action of housing 16 occurs when pressure is released from housing 16. When this occurs, weights will drop and cable 14 will pull cable 146 towards frame 20, thereby pulling cam 148 into a centering position and thereby centering housing 16 in the rest position The user may thereby apply lateral forces against handle 110 to initiate rotation of housing 16 and repeat such action by releasing lateral pressure and then again rotating housing 16.

Handle Pivot

The pivoting of handle 110 about bolt 108 will now be discussed with reference to FIGS. 1 and 2. Handle 110 is shown in its rest position with the handle essentially vertical, in FIG. 1. The user may pivot handles 110 in either direction, that being either the direction of arrow 112 in FIG. 2, or in the opposite direction. Such movement will cause cable 168 to wind about the groove in the outer periphery of cam 104 thereby pulling cable 168 in the direction of handle 110. The pulling action on cable 168 will cause floating pulley system 162 to rise upwardly within shaft 62 thereby applying pulling pressure on cable 14. Cable 14 is then pulled in the directions of arrows 194 (FIG. 2) and 190 (FIG. 1). This lifts selected weight 12 against gravity in the direction of arrow 196 (FIG. 1). This causes resisting force to be applied by apparatus 10 against pivotal movement of handle 110. Again, releasing such pivotal pressure on handle 110 will cause weights 12 to drop, thereby pulling cable 14 in the opposite direction and moving floating pulley system 162 downward in shaft 62. This will cause pulling pressure on cable 168 in a reverse direction thereby centering clamp 176 between pulleys 102 and holding hand 110 in its vertical rest position depicted in FIG. 1.

Extension Twist Rotation

The user may also elect to twist handle 110 and thereby sleeve 86 along the longitudinal axis within and respective to extension 18. The user may. apply twisting rotation motion in a clockwise or anti-clockwise direction, on handle 110 to cause corresponding twisting rotation movement of sleeve 86 within extension 18 by movement at bushings 88 and 90. This movement causes one of pulleys 128 to engage cable 168 thereby applying pulling pressure on cable 168 and lifting pulley system 162 upwardly in shaft 62. This causes pulling pressure on cable 14 moving cable 14 in the directions of arrows 194 and 190. This also lifts weights 12 against gravity in the direction of arrow 196 thereby applying resisting pressure against the said twisting rotating motion on handle 110. When the twisting rotating pressure is released from handle 110, weights 12 fall thereby pulling cable 14 in the opposite direction and moving pulley system 162 downward in shaft 62. This pulls cable 168 against pulleys 128 causing cam 122 to move back to its rest position with handle 110 oriented generally in a vertical position. Stops (554) on cam 122 18 prevent excessive twist rotation of handle 110 by striking corresponding stops 554 on cam 122 (FIG. 3).

The user may decide to selectively use any of pulling, pushing, horizontal rotation, vertical pivot and twist rotation motion either individually or simultaneously in any desired combination. All of these actions act on one resistance force, causing weights 12 to be lifted against gravity.

Dummy

As shown in FIGS. 10 and 11, the user may optionally attach dummy 300 to handle 110 for the purpose of training against a simulated opponent. In addition to the previously described pulling, pushing, and rotational options presented to the user, the dummy provides further features which allow the user to attach or detach the head and neck, each individual arm or leg from the torso of the dummy. Further the user may wish to position each limb at a specific angle relative to the torso and this is accomplished by placing locking pins in aligned holes in the receiving pipes welded in the cavity of the torso. Further each limb is flexible about the major joints of the limbs which allows the user to twist and bend the limb for realistic and functional training programs.

For example, a judo player may practice throwing the dummy against resistance as the dummy will rotate in any direction about its centre of gravity, a karate player may position the limbs in any position relative to the vertical alignment of the torso, to practice striking skills, a football player may position the dummy to practice blocking skills, etc. and the like.

A-Frame

As shown in FIGS. 8 and 9, the user may optionally attach "A" frame structure 400 to apparatus 10 for the purpose of testing, measuring and exercising functional abilities related to continuous pulling, lifting and carrying types of activities. For example those associated with fire and rescue duties, ambulance lifting carrying and pushing duties, warehouse pushing, pulling, lifting and carrying work, etc. The operation of the options within the current design of the "A" frame include the user grasping pulling on rope 430. When rope 440 is pulled, wheel 444 is turned which turns resistance wheel 446. Belt 448 wraps around resistance wheels 442 and 446 rotatably attach the two wheels. Depending on the degree of tension and surface friction of the bevelled surface 458, rope 430 will cause rotation of wheel 444 and, in turn, wheel 440 which pulls cable 14 about wheel 440 to lift weights 12. This rotation is resisted by the amount of weight the user chooses to place as a resistance on cable 14. In the current design the user must adjust the tension and friction level to the weight resistance level desired.

Optionally, the user may attach cable 484 to cable 468 by means of attachment member 436. The user may then pull on handle 486 to pull cable 434, cable 146 and cable 14 to lift weights 12.

We claim:

1. A testing, training and exercise apparatus, comprising:

(a) an upstanding frame, (b) support means rotatably supported by said frame for unrestricted rotation about a support means access of rotation, (c) a resisting force, (d) force receiving extension supported by said support means having a longitudinal axis perpendicular to the axis of said support means axis, said extension comprising a first end extending along said longitudinal axis of said extension beyond the periphery of said support means, said extension movable with respect to said support means in the direction of said support means axis along said longitudinal axis to cause force to be applied against said resisting force, (e) resisting force connecting means for connecting said extension to said resisting force responsive to the application of force on said extension to cause force to be applied against said resisting force when said extension is moved along said longitudinal axis.

2. An apparatus as described in claim 1, wherein said resisting force is supported by said frame and wherein a portion of said connecting means extends parallel with, and passes substantially through, the said support means axis.

3. An apparatus as described in claim 1, further comprising pendulum swing means for movably connecting said extension to said support means, wherein said pendulum swing means permits slideable movement of said extension along its said longitudinal axis between a rest position wherein an end of said extension extends substantially from said support means and a retracted position wherein said end of said extension is essentially retracted within said support means and wherein force is applied against the resisting force when the said extension is moved toward said retracted position.

4. An apparatus as described in claim 1, wherein said extension comprises rotatable wheels and said support means comprises a longitudinal track adapted to receive said wheels for rolling on said track, said wheels supporting said extension as said extension moves longitudinally along said support means to cause force to be applied against said resisting force.

5. An apparatus as described in claim 1, wherein said extension includes extension sliding portion and wherein said support means includes complementary support means sliding portions, slideably connecting said extension to said support for sliding when said extension moves longitudinally along said support means to cause force to be applied against said resisting force.

6. An apparatus as described in claim 5, wherein said extension sliding portion is a rod longitudinally attached to said extension and wherein said complementary support means sliding portions is a bearing means slideably engaging said rod for longitudinal movement of said rod within said bearing means.

7. An apparatus as described in claim 1, further comprising height adjusting means for adjusting the height of said extension with respect to said frame.

8. An apparatus as described in claim 1 further comprising push connecting means attached to said extension at one end and movably attached to said support means at an intermediate zone and to said resisting force connecting means at the other end, said push connecting means causing pressure to be applied on said resisting force connecting means causing pressure to be applied against said resisting force, when said extension is moved longitudinally along said support means.

9. An apparatus as described in claim 8 further comprising directing means connected to said support means for directing a portion of said push connecting means parallel with and substantially through the said support means axis, said directing means causing force to be applied on said pull connecting means when said extension is moved from said extended towards said retracted positions of said extension.

10. An apparatus as described in claim 9, wherein said directing means is adjacent to said support means axis.

11. An apparatus as described in claim 1, wherein said directing means is a pulley rotatably attached to said support means.

12. An apparatus as described in claim 1 further comprising pulling means for pulling said extension to cause force to be applied against said resisting force.

13. An apparatus as described in claim 12 further comprising pull connecting means attached at a first end of said extension and movably attached to said support means at an intermediate zone of said pull connecting means, said pull connecting means pullable to cause said extension to move from said retracted position toward said extended position of said extension thereby causing force to be applied on said resisting force connecting means to cause force to be applied against said resisting force.

14. An apparatus as described in claim 13 further comprising directing means connected to said support means for directing a portion of said pull connecting means and for applying force on said extension to cause the extension to move from the retracted to extended positions of said extension when pulling force is applied on said pull connecting means.

15. An apparatus as described in claim 14, wherein said directing means is located adjacent to said support means axis.

16. An apparatus as described in claim 14, wherein said directing means is a pulley rotatably attached to said support means.

17. An apparatus as described in claim 1 further comprising rotation connecting means for connecting said resisting force connecting means to said support means, said rotation connecting means connected to said support means at one end and to said resisting force connecting means at the other end to cause force to be applied on said resisting force connecting means to apply force against said resisting force when said support means is rotated about said support means axis.

18. An apparatus as described in claim 17, further comprising directing means for directing an intermediate portion of said rotation connecting means and for applying force on said rotation connecting means when said support means is rotated about said support means axis, said directing means movably engaging an intermediate portion of said rotation connecting means.

19. An apparatus as described in claim 18, wherein said directing means comprises a cam connected to said support means for co-axial rotation with said support means, said cam comprising a semi-circular outer periphery, said outer periphery comprising guide means for guiding said intermediate portion of said rotation connecting means along said outer periphery.

20. An apparatus as described in claim 19, wherein said guide means comprises a slot along said outer periphery of said cam.

21. An apparatus as described in claim 20, wherein said rotation connecting means is attached to said cam at said first end, along a center line of said cam extending from said axis to said periphery, dividing said cam in essentially equal portions.

22. An apparatus as described in claim 21, wherein rotation connecting means is connected to said resisting force connecting means at said second end by a rotatable floating connecting means for movably connecting a segment of said resisting force connecting means with said second end of said rotation connecting means.

23. An apparatus as described in claim 22, wherein said rotatable floating connecting means comprises a pulley rotatably connected to said second end of said rotation connecting means, said pulley movably connected to said section of said resisting force connecting means and rotatably connected to said second end.

24. An apparatus as described in claim 17, further comprising first securing means for securing said support means to said frame to prevent rotation about said support means axis of rotation.

25. An apparatus as described in claim 24, wherein said support means returns to a first normal position when force is not applied against the said resisting force.

26. An apparatus as described in claim 25, further comprising first varying means for varying- said first normal position to a pre-determined position about the said support means axis.

27. An apparatus as described in claim 1, wherein said extension comprises a first portion and a second portion, said second portion rotatable with respect to said first portion along the said longitudinal axis of said extension, said first portion connected to said support means and said second portion comprising a first end extending outward from said extension along said longitudinal axis of said extension.

28. An apparatus as described in claim 27 further comprising twist connecting means attached to said first portion of said extension at a first end and connected to said resisting force connecting means at a second end and further comprising directing means attached to said second portion movably connected to an intermediate portion of said twist connecting means, for directing and for applying force on said twist connecting means to cause force to be applied on said resisting force connecting means to apply force against said resisting force, when said second portion is twisted with respect to said first portion.

29. An apparatus as described in claim 28, wherein said directing means comprises a cam connected to said second portion for co-axial rotation with said second portion, said cam comprising a semi-circular outer periphery, said outer periphery comprising guiding means for guiding said intermediate portion of said twist connecting means along said outer periphery.

30. An apparatus as described in claim 29, wherein said guide means comprises a slot along said outer periphery of said cam.

31. An apparatus as described in claim 30, wherein said twist connecting means is attached to said cam at a first end, along a center line of said cam extending from said axis to said periphery, dividing said cam in essentially equal portions.

32. An apparatus as described in claim 31, wherein said twist connecting means is connected to said resisting force connecting means by means of rotatable floating connecting means.

33. An apparatus as described in claim 32, wherein said rotatable floating connecting means comprises a pair of pulleys rotatably connected together, the first pulley movably engaging said twist connecting means and said second pulley movably engaging said resisting force connecting means.

34. An apparatus as described in claim 33 further comprising second twist connecting means directing means connected to said support means, for directing a portion of said twist connecting means adjacent said support means axis.

35. An apparatus as described in claim 34, wherein said second twist connecting means directing means comprises a pulley rotatably attached to said support means.

36. An apparatus as described in claim 34, wherein said rotatable floating connecting means is located adjacent, and in alignment with, said support means axis.

37. An apparatus as described in claim 27, further comprising second securing means for securing said first portion to said second portion to prevent rotation of said second portion with respect to said first portion about said longitudinal axis of said second portion.

38. An apparatus as described in claim 27, wherein said second portion returns to a second normal position when force is not applied to rotate said second portion with respect to said first portion.

39. An apparatus as described in claim 38, further comprising second varying means for varying said second normal position to a pre-determined normal position about said longitudinal axis of said second portion.

40. An apparatus as described in claim 1 further comprising a handle pivotally connected to a first end of said extension for pivotable movement about a handle pivot axis substantially perpendicular to the longitudinal axis of said extension.

41. An apparatus as described in claim 40 further comprising pivot connecting means for connecting said handle to said resisting force connecting means, attached to said handle at a first end and to said resisting force at a second end whereby said pivot connecting means applies force on said resisting force to apply force against said resisting force when said handle is pivoted about said handle pivot axis.

42. An apparatus as described in claim 41 further comprising directing means connected to said handle for directing an intermediate portion of said pivot connecting means and for applying force on said pivot connecting means when said handle is pivoted about said handle pivot axis, said directing means movably engaging an intermediate portion of said pivot connecting means.

43. An apparatus as described in claim 42, wherein said directing means comprises a cam connected to said handle in a plane perpendicular to said handle pivot axis, co-axial with the axis of rotation of said handle, said cam comprising a semi-circular outer periphery, said outer periphery comprising guide means for guiding said intermediate portion of said pivot connecting means along said outer periphery.

44. An apparatus as described in claim 43, wherein said guide means comprises a slot along said outer periphery of said cam.

45. An apparatus as described in claim 44, wherein said pivot connecting means is attached to said cam at a first end along a center line of said cam extending from said axis to said periphery, dividing said cam in essentially equal portions.

46. An apparatus as described in claim 45, wherein said second end of said pivot connecting means is connected to said resisting force connecting means by means of rotatable floating connecting means for movably connecting a segment of said resisting force connecting means with an end of said pivot connecting means.

47. An apparatus as defined in claim 46, wherein said rotatable floating connecting means comprises a pair of pulleys rotatably connected together, said second end of said pivot connecting means attached to a first of said pulleys and wherein a portion of said resisting force connecting means is connected to said second of said pulleys.

48. An apparatus as described in claim 47, wherein said floating rotatable connecting means is located adjacent said support means axis.

49. An apparatus as described in claim 48 further comprising second directing means attached to said housing, for directing a portion of said pivot connecting means adjacent said support means axis.

50. An apparatus as described in claim 49, wherein said second directing means is a pulley rotatably attached to said support means.

51. An apparatus as described in claim 40, further comprising third securing means for securing said handle to said first end of said extension to prevent pivotable movement about said handle pivot axis.

52. An apparatus as described in claim 40, wherein said handle returns to a third normal position when force is not applied to pivot said handle about said handle pivot axis.

53. An apparatus as described in claim 52, further comprising third varying means for varying said third normal position to a pre-determined normal position about said handle pivot axis.

54. An apparatus as described in claim 1 further comprising rope pulling means, said rope pulling means rotatably connected to said connecting means to cause force to be applied against said resisting force when said rope pulling means is pulled.

55. An apparatus as described in claim 54 further comprising upward pulling means, said upward pulling means connected to said connecting means to cause force to be applied against said resisting force when upward pressure is applied on said upward pulling means.

56. An apparatus as described in claim 1, further comprising a target removably attached to said force receiving extension.

57. An apparatus as described in claim 56, wherein said target comprises an artificial human-shaped dummy.

58. An apparatus as described in claim 1, further comprising height adjusting means for adjusting the height of said support means with respect to said frame.

59. An apparatus as described in claim 1, wherein said resisting force is either a weight, a weight stack, a spring, pneumatic cylinders, motorized resistance or a magnetic resistance.

* * * * *